US012331983B2

(12) United States Patent
Choi

(10) Patent No.: US 12,331,983 B2
(45) Date of Patent: Jun. 17, 2025

(54) REFRIGERATOR

(71) Applicant: LG Electronics Inc., Seoul (KR)

(72) Inventor: Joonyoung Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 121 days.

(21) Appl. No.: 17/798,819

(22) PCT Filed: Sep. 28, 2021

(86) PCT No.: PCT/KR2021/013279
§ 371 (c)(1),
(2) Date: Aug. 10, 2022

(87) PCT Pub. No.: WO2022/108092
PCT Pub. Date: May 27, 2022

(65) Prior Publication Data

US 2023/0266046 A1 Aug. 24, 2023

(30) Foreign Application Priority Data

Nov. 17, 2020 (KR) ..... 10-2020-0153610

(51) Int. Cl.
*F25D 17/04* (2006.01)
*F25D 17/06* (2006.01)

(52) U.S. Cl.
CPC ..... *F25D 17/045* (2013.01); *F25D 17/062* (2013.01); *F25D 2317/0653* (2013.01)

(58) Field of Classification Search
CPC ..... F25D 2317/0653; F25D 17/067
See application file for complete search history.

(56) References Cited

U.S. PATENT DOCUMENTS 4,768,353 A * 9/1988 Bushser ..... F25D 17/065 62/419
5,632,160 A * 5/1997 Harangozo ..... F25D 17/065 62/408

(Continued)

FOREIGN PATENT DOCUMENTS

CN 110895071 A 3/2020
JP 2012-255602 A 12/2012

(Continued)

OTHER PUBLICATIONS

Office Action in Australian Appln. No. 2021382499, mailed on May 25, 2023, 4 pages.

(Continued)

*Primary Examiner* — Lionel Nouketcha
(74) *Attorney, Agent, or Firm* — Fish & Richardson P.C.

(57) ABSTRACT

A refrigerator is proposed. The refrigerator may include a cabinet having a storage compartment (F1, F2), and a barrier (30) dividing the storage compartment (F1, F2) into multiple spaces. In addition, a grille fan assembly 50 may be erected at the rear of the storage compartment (F1), and a blower fan (80) configured to blow cold air may be mounted to the grille fan assembly 50. The grille fan assembly (50) may be provided with the control knob (90), and the control knob (90) may be rotated relative to a rotating shaft configured in the same direction as a rotating shaft of the blower fan (80) such that the amount of the blown air can be controlled.

20 Claims, 18 Drawing Sheets

(56) References Cited

U.S. PATENT DOCUMENTS

| | | | | |
|---|---|---|---|---|
| 5,911,750 | A * | 6/1999 | Mandel | F25D 17/065 62/89 |
| 6,293,122 | B1 * | 9/2001 | Chang | F25D 21/14 62/414 |
| 7,051,539 | B2 * | 5/2006 | Junge | F25D 17/045 62/90 |

FOREIGN PATENT DOCUMENTS

| | | |
|---|---|---|
| KR | 19990030012 | 4/1999 |
| KR | 200345579 | 3/2004 |
| KR | 10-2017-0006995 A | 1/2017 |
| KR | 102176725 | 11/2020 |
| WO | WO2022/108092 | 5/2022 |

OTHER PUBLICATIONS

Extended European Search Report in European Appln. No. 21894864.4, mailed on Sep. 17, 2024, 8 pages.

Office Action in Indonesian Appln. No. P00202206535, mailed on Nov. 1, 2024, 6 pages (with English Translation).

* cited by examiner

REFRIGERATOR

CROSS-REFERENCE TO RELATED APPLICATIONS

This application is a National Stage application under 35 U.S.C. § 371 of International Application No. PCT/KR2021/013279, filed on Sep. 28, 2021, which claims the benefit of Korean Patent Application No. 10-2020-0153610, filed on Nov. 11, 2020. The disclosures of the prior applications are incorporated by reference in their entirety.

TECHNICAL FIELD

The present disclosure relates generally to a refrigerator. More particularly, the present disclosure relates to a refrigerator in which a grille fan assembly configured to discharge cold air is installed.

BACKGROUND ART

In general, a refrigerator is a home appliance that is provided to store various foods or beverages for a long time with cold air generated by using the circulation of a refrigerant according to refrigeration cycle. Such a refrigerator may be classified into a top freezer refrigerator in which a freezer compartment is disposed above a refrigerating compartment, a bottom freezer refrigerator in which the freezer compartment is disposed below the refrigerating compartment, and a side by side refrigerator in which the refrigerating compartment and the freezer compartment are located by being partitioned side by side.

Among these, in the case of the top freezer refrigerator, an evaporator is located in the rear space of the inside of the freezer compartment, and a grille fan assembly in which a blower fan for supplying and circulating cold air is installed is provided in front of the evaporator.

A flow guide for the refrigerating compartment is formed in the grille fan assembly so as to guide cold air blown by the blower fan after passing through the evaporator such that some of the cold air is supplied to the refrigerating compartment, and the opening/closing amount of the flow guide for the refrigerating compartment is controlled by a thermostat such that the temperature of the inside of the freezer compartment is controlled.

A discharge hole is formed at the lower part of the flow guide for the refrigerating compartment, and through the discharge hole, cold air may be discharged to the refrigerating compartment. In this case, the discharge hole may be connected to a communication hole of the barrier separating the freezer compartment from the refrigerating compartment. Accordingly, through the connection structure of the discharge hole with the communication hole, some of the cold air may be supplied to the refrigerating compartment.

Such a top freezer refrigerator is disclosed in Korean Utility Model Publication No. 20-1901-0002814, Korean Patent Application Publication No. 10-2016-0100548, and Koran Patent Application Publication No. 10-2017-0006995, etc. However, after the grille fan assembly is manufactured as a separate object, the grille fan assembly is mounted to the freezer compartment. In the process of mounting the grille fan assembly to the freezer compartment, the lower part of the grille fan assembly interferes with the upper surface of the freezer compartment and parts thereof may be damaged.

Particularly, the communication hole connected with the discharge hole is formed through the bottom surface of the freezer compartment, and sealing foam for preventing the leakage of cold air is formed in the surrounding area of the communication hole and the discharge hole. In the process of assembling the grille fan assembly, the lower part of the grille fan assembly may remove or damage the sealing foam. In this case, cold air leaks at a position between the discharge hole and the communication hole, or the removed sealing foam blocks a connection portion therebetween and prevents the efficient flow of cold air.

Furthermore, the thermostat described above has a structure approximate to a disk, and a rotating shaft thereof is configured in a vertical direction, so the thermostat is installed in a lying state in the refrigerator. Accordingly, a user controls the amount of cold air by rotating the thermostat clockwise/counterclockwise.

In this case, since the thermostat exposed in a direction toward the user looks like the structure of a lying disk, it is difficult for the user to know exactly the amount of manipulation of the thermostat which the user manipulated. Additionally, an area for printing an operation scale on the thermostat is also small, making it more difficult for the user to recognize the operation scales.

In addition, the thermostat described above requires a plate-shaped opening/closing plate for controlling the amount of cold air and parts for rotating the same, so the total number of parts and assembly work increase.

DOCUMENTS OF RELATED ART (Patent Document 1) Korean Utility Model Publication No. 20-1991-0002814

(Patent Document 2) Korean Patent Application Publication No. 10-2016-0100548

(Patent Document 3) Korean Patent Application Publication No. 10-2017-0006995

DISCLOSURE

Technical Problem

Accordingly, the present disclosure has been made keeping in mind the above problems occurring in the related art, and the present disclosure is intended to propose a refrigerator in which the interference of a grille fan assembly with a freezer compartment is prevented in the process of mounting the grille fan assembly to the refrigerator.

In addition, the present disclosure is intended to propose a refrigerator in which the rotating shaft of a control knob for controlling the temperature of the freezer compartment is configured in the front-to-rear depth direction of the freezer compartment such that the control knob is exposed to a user in the form of a cylindrical dial.

Furthermore, the present disclosure is intended to propose a refrigerator in which the structure of the control knob is simplified and the amount of cold air supplied to a refrigerating compartment is sufficiently secured.

Technical Solution

In order to achieve the above objectives, according to one aspect of the present disclosure, a refrigerator of the present disclosure may include a cabinet having a storage compartment, and a barrier dividing the storage compartment into multiple spaces. Additionally, a grille fan assembly may be erected at the rear of the storage compartment, and a blower fan blowing cold air may be mounted to the grille fan assembly. The grille fan assembly may be provided with a control knob, and the control knob may be rotated relative to a rotating shaft thereof configured in the same direction as the rotating shaft of the blower fan such that the amount of blown air can be controlled.

In this case, inclined parts may be formed on the upper surface of the barrier and the lower surface of the grille fan assembly, respectively, such that the inclined parts are in close contact with each other. Accordingly, while mounting the grille fan assembly, the interference of the grille fan assembly with a freezer compartment may decrease, and damage to the grille fan assembly or the freezer compartment may be prevented.

The inclined parts may include a first inclined part located on the upper surface of the barrier and formed by surrounding the edge of a communication hole, and a second inclined part located on the lower surface of the grille fan assembly and formed by surrounding the edge of a discharge hole. Furthermore, the first inclined part and the second inclined part may be in close contact with each other.

In addition, each of the first inclined part and the second inclined part may be slantingly configured to have height increasing gradually toward the rear of the cabinet and may have the same inclination angle.

Furthermore, a sealing part sealing a part at which the communication hole and the discharge hole are connected to each other may be formed on at least any one of the first inclined part and the second inclined part.

Additionally, a holding groove into which the upper end of the grille fan assembly is inserted may be formed on the upper surface of the storage compartment facing the communication hole.

In addition, height between the upper surface of the grille fan assembly and the second inclined part may be higher than or the same as height between the holding groove and the first inclined part.

Furthermore, a mounting part in which the communication hole is formed may protrude on the upper surface of the barrier, and the first inclined part may be formed on the upper surface of the mounting part.

Additionally, a pair of guide ribs may protrude on the lower surface of the grille fan assembly adjacent to the second inclined part and may surround the periphery of the first inclined part.

In addition, the barrier may include a barrier body having a recovery duct formed therein, and a barrier cover coupled to the upper part of the barrier body and shielding at least a portion of the recovery duct. In this case, the mounting part may protrude on the upper surface of the barrier cover.

Furthermore, the grille fan assembly may be provided with a lower plate located under the control knob, and the discharge hole may be formed through the lower plate. The second inclined part may be formed on the surface of the lower plate facing the upper surface of the barrier cover.

Additionally, the lower plate may be separated from each of the opposite side parts of the grille fan assembly and may be provided at the center portion of the lower part of the grille fan assembly.

In addition, the control knob may include: a cylindrical knob body having at least a portion protruding from the grille fan assembly toward the front of the storage compartment, and an angle adjustment part protruding from the outer circumferential surface of the knob body. The angle adjustment part may interfere with an adjustment law of the grille fan assembly. An opening/closing blade may be connected to the knob body by a connection arm.

Furthermore, the surface of the opening/closing blade may have a curved shape, and may be spaced apart from the inner surface of an opening/closing entrance of the flow path for the refrigerating compartment.

Additionally, the opening/closing blade may have a width larger than a width of the opening/closing entrance of the flow refrigerating compartment.

In addition, the opening/closing blade may include an enlarged open part formed by recessing a portion of the opening/closing blade, and due to the enlarged open part, the open area of the opening/closing entrance of the flow path for the refrigerating compartment may increase.

Furthermore, a rotating boss may protrude on the knob body, and may be fitted rotatably to a fixed boss of the grille fan assembly.

Additionally, support legs may protrude on the knob body, and may be in close contact with the inner surface of the grille fan assembly.

In addition, a close-contact protrusion part may protrude on the angle adjustment part and may be in close contact with an opposing inner surface facing an inner surface of the grille fan assembly in close contact with the support legs in the opposite inner surfaces of the grille fan assembly.

Furthermore, the angle adjustment part may be provided continuously along the outer circumferential surface of the knob body, and the control recess may be recessed on the surface of the angle adjustment part such that the adjustment jaw can be fitted into the control recess.

A stopper may protrude on the inner surface of the grille fan assembly, and may interfere with the side surface of the connection arm to limit the maximum rotation angle of the control knob. In this case, the stopper may be composed of a first stopper and a second stopper spaced apart from each other such that the first stopper and the second stopper may limit the maximum and minimum opening angles of the control knob, respectively.

Advantageous Effects

The refrigerator of the present disclosure described above may have the following effects.

In the refrigerator of the present disclosure, inclined parts corresponding to each other may be formed between the lower surface of the grille fan assembly and the bottom surface of the freezer compartment in close contact therewith, so in the mounting process of the grille fan assembly, the interference of the grille fan assembly with the freezer compartment may decrease. Accordingly, in the mounting process of the grille fan assembly, damage to the grille fan assembly or the freezer compartment may be prevented.

Particularly, a sealing foam may be formed at a flow path entrance (the communication hole) for transmitting cold air, and since in the mounting process of the grille fan assembly, the interference of grille fan assembly is prevented, the sealing foam may not be damaged or removed, and the leakage of cold air may be prevented. Accordingly, the efficiency of the refrigerator may be improved, and the temperature control accuracy of the freezer compartment may increase.

In addition, in the refrigerator of the present disclosure, the flow path entrance (the communication hole) for transmitting cold air may be configured in an inclining direction, so the area of the flow path entrance may increase compared to a planar shape thereof. Accordingly, the amount of cold air transmitted to the refrigerating compartment may be further increased and the flow of the cold air may be further facilitated.

Furthermore, in the refrigerator of the present disclosure, the rotating shaft of the control knob for controlling the temperature of the freezer compartment may be provided in the front-to-rear depth direction of the freezer compartment, and the control knob may be exposed to a user in the form of a cylindrical dial. Accordingly, a user may rotate the control knob more intuitively, so the usability and beauty of the control knob may be improved.

In addition, a user may control the temperature of the freezer compartment by turning the control knob having the shape of a cylindrical dial, so the user may more accurately recognize the state of the control knob which the user manipulated. Accordingly, the manipulability of the control knob may be improved.

Particularly, when a user manipulates the control knob, the user may cover and grip the outer circumferential surface of the cylindrical control knob. Accordingly, a user may accurately grip the control knob without sliding.

Furthermore, the control knob may be installed in the grille fan assembly in an upright direction instead of in a lying direction, so a front-to-rear directional width occupied by the control knob in the grille fan assembly may decrease. Accordingly, in the refrigerator of the present disclosure, although the control knob is installed at the center portion of the grille fan assembly, the grille fan assembly may be made to have a small thickness.

Additionally, the control knob of the present disclosure may have a curved shape, and may be configured to be spaced apart from the inner surface of a flow guide for the refrigerating compartment. Accordingly, water flowing down through the flow guide for the refrigerating compartment may not accumulate on the control knob, but may flow downward along the surface of the control knob. Accordingly, the periphery of the control knob may be prevented from freezing.

In addition, in the refrigerator of the present disclosure, the control knob may be configured as a part, and may be made as a simple structure fitted rotatably to the fixed boss provided in the grille fan assembly. Accordingly, the entire assembly of the control knob may be simply performed, and due to minimized components, freezing points between relative parts may be decreased.

Furthermore, in the refrigerator of the present disclosure, the entire outer circumferential surface of the opening/closing blade provided in the control knob may function to control the open degree of the flow guide for the refrigerating compartment. Accordingly, the amount of cold air discharged during the complete opening of a flow path may be maximized, and the amount of the cold air transmitted to the refrigerating compartment may be increased.

Additionally, in the refrigerator of the present disclosure, the lower plate through which a discharge hole is formed may be provided on the lower part of the grille fan assembly, and may be configured individually by being separated from the opposite side surfaces of the grille fan assembly. Accordingly, when mounting the grille fan assembly to the freezer compartment, the lower plate may be elastically transformed more efficiently while being guided by the inclined parts, and the mountability of the grille fan assembly may be improved.

MODE FOR INVENTION

Figure 1:
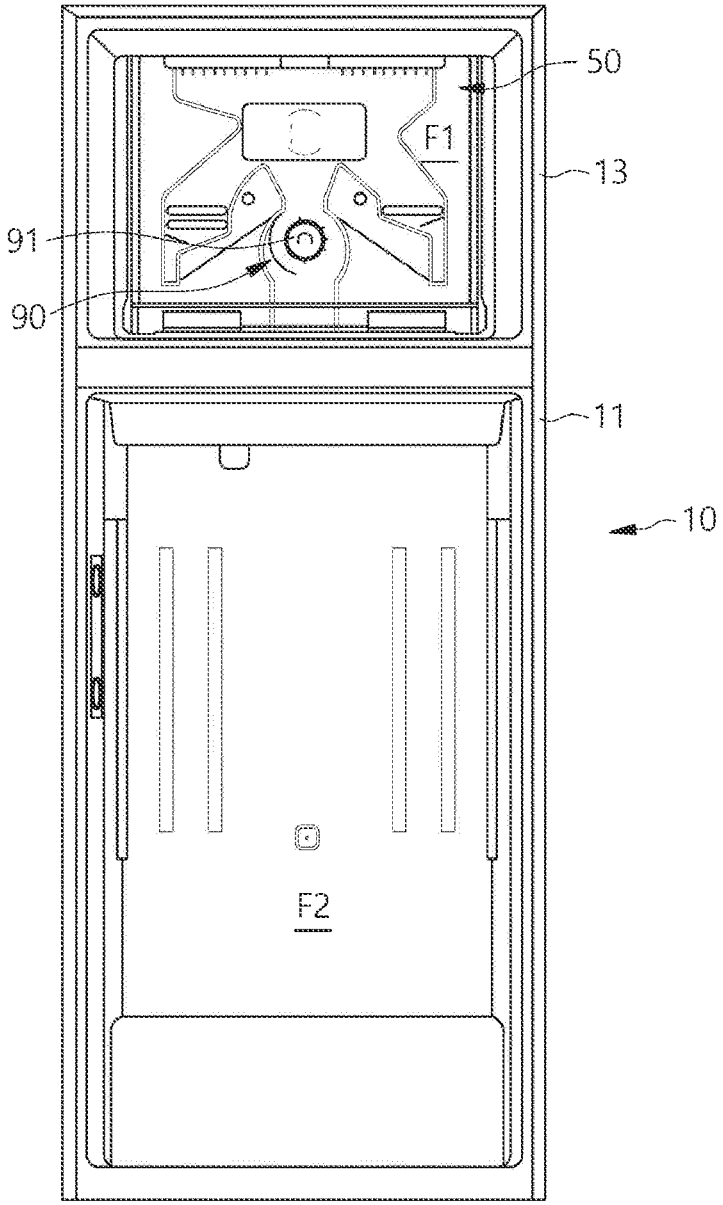
FIG. 1 is a front view illustrating the configuration of a cabinet constituting a refrigerator according to an embodiment of the present disclosure.

Hereinafter, an embodiment of the present disclosure will be described in detail with reference to exemplary drawings. In giving reference numerals to components in each drawing, it should be noted that the same components are given the same reference numerals as much as possible although they are illustrated in different drawings. In addition, in describing the embodiment of the present disclosure, when it is determined that a detailed description of a related known configuration or function interferes with the understanding of the embodiment of the present disclosure, a detailed description thereof will be omitted.

The present disclosure relates to a refrigerator. In the refrigerator of the present disclosure, cold air generated in an evaporator installed at the rear side of a freezer compartment F1 may be supplied into the freezer compartment F1. In addition, some of the cold air may be transmitted to a refrigerating compartment F2 disposed under the freezer compartment F1. The transmission of cold air between the freezer compartment F1 and the refrigerating compartment F2 may be performed by a grille fan assembly 50. The grille fan assembly 50 may discharge some of cold air generated by the evaporator toward the refrigerating compartment F2.

In this case, the grille fan assembly 50 may be erected on the upper part of the barrier 30. The barrier 30 may separate the freezer compartment F1 from the refrigerating compartment F2. Sealing foam may be formed at a part at which the grille fan assembly 50 and the barrier 30 are in close contact with each other and may prevent the leakage of cold air. In the refrigerator of the present disclosure, inclined parts A1 and A2 may be formed on the close-contact part between the grille fan assembly 50 and the barrier 30, and thus during the mounting process of the grille fan assembly 50 to the freezer compartment F1, the removal of the sealing foam may be prevented.

Figure 2:
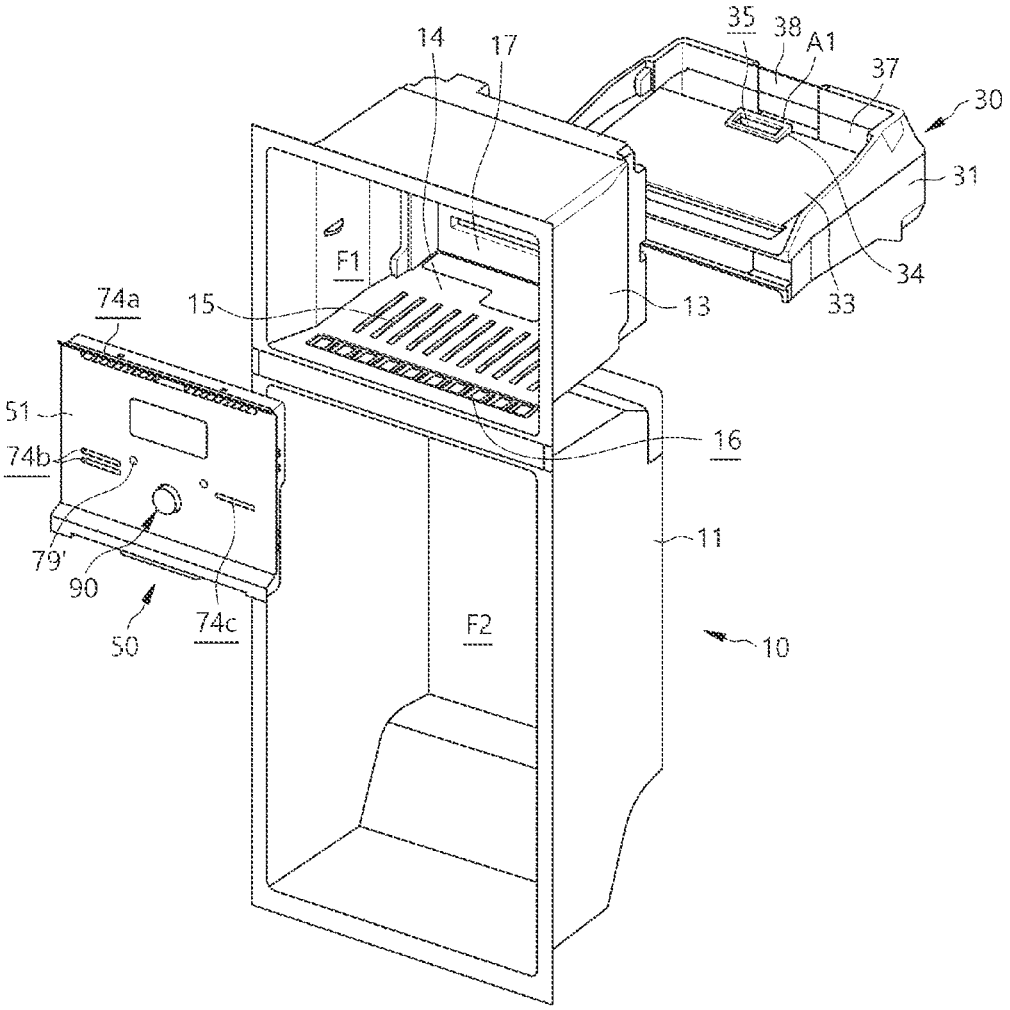
FIG. 2 is a perspective view illustrating a state in which a barrier and a grille fan assembly of parts constituting the refrigerator illustrated in FIG. 1 are removed from the cabinet.

Referring to FIGS. 1 and 2, a cabinet constituting the refrigerator according to the embodiment of the present disclosure is illustrated. More specifically, the cabinet may be composed of an outer casing and an inner casing 10, and foaming liquid may be filled between the outer casing and the inner casing 10 to form an insulating part. In FIGS. 1 and 2, the inner casing 10 is illustrated.

Referring to the structure of the inner casing 10, the freezer compartment F1 may be provided at the upper side of the inner casing 10, and the refrigerating compartment F2 may be provided at the lower side of the freezer compartment F1. The freezer compartment F1 and the refrigerating compartment F2 may be storage compartments separated from each other and may be space capable of storing food. The frame of the refrigerating compartment F2 may be constituted by a lower casing 11, and the frame of the freezer compartment F1 may be constituted by an upper casing 13. Of course, alternatively, the freezer compartment F1 may be located at the lower side and the refrigerating compartment F2 may be located at the upper side.

The freezer compartment F1 and the refrigeration compartment F2 may already be partitioned from each other by a bottom surface 14 of the freezer compartment F1, but the bottom surface 14 of the freezer compartment F1 may be a structure that is open downward due to a path including a duct inlet 16. Accordingly, the freezer compartment F1 and the refrigerating compartment F2 may be substantially separated from each other by the barrier 30 to be described later.

Referring to the freezer compartment F1, the bottom surface 14 of the freezer compartment F1 may have a structure of a flat plate, and multiple rib structures 15 may protrude on the bottom surface 14 of the freezer compartment F1. The duct inlet 16 may be formed in the bottom surface 14 of the freezer compartment F1 close to an entrance thereof. The duct inlet 16 may be an entrance to a path through which cold air supplied to the freezer compartment F1 is recovered, and the cold air of the freezer compartment F1 may be introduced into the barrier 30 through the duct inlet 16, and may be recovered back to the evaporator through a recovery duct located in the barrier 30.

The deepest inner surface of the inner casing 10 may be a rear plate 17 of the inner casing 10. In FIG. 2, the rear plate 17 is exposed to the front side, but after the grille fan assembly 50 is installed, the rear plate 17 is covered by the grille fan assembly 50, and thus may not be exposed to the front side.

An empty space located between the rear plate 17 and the grille fan assembly 50 may be an evaporation chamber in which the evaporator (not shown) is installed. That is, the inner space of the upper casing 13 may be divided into the freezer compartment F1 located at a front side relative to the grille fan assembly 50, and the evaporation chamber defined between the grille fan assembly 50 and the rear plate 17.

The inner casing 10 may be coupled to the outer casing to constitute the cabinet, and although not shown, doors may be mounted to the cabinet. The doors are intended to shield the freezer compartment F1 and the refrigerating compartment F2, and may include a door for the freezer compartment F1 and a door for the refrigerating compartment F2 installed independently of each other.

The barrier 30 may be disposed between the upper casing 13 and the lower casing 11 of the inner casing 10. The barrier 30 may function to separate the freezer compartment F1 from the refrigerating compartment F2. Furthermore, the barrier 30 may function (i) to recover the cold air of the freezer compartment F1 and to transmit the cold air to the evaporation chamber, (ii) to transmit some of cold air discharged by the grille fan assembly 50 after being generated by the evaporator to the refrigerating compartment F2, and (iii) to recover the cold air of the refrigerating compartment F2 and to transmit the cold air to the evaporation chamber.

As illustrated in FIG. 2, the barrier 30 may have a shape approximate to a rectangular frame, and may be composed of multiple parts. The barrier 30 may include a barrier body 31. The barrier body 31 may have a shape approximate to a hexahedron and may have the recovery duct (not shown) formed therein. The recovery duct is a flow path configured to recover the cold air of the freezer compartment F1 back to the evaporator, and the duct inlet 16 which is the entrance of the recovery duct may be formed on the bottom surface 14 of the freezer compartment F1. For reference, a duct structure for recovering the cold air of the refrigerating compartment F2 may be formed inside the barrier 30.

A barrier cover 33 may be disposed on the upper part of the barrier body 31. The barrier cover 33 may have a flat plate structure covering the upper part of the barrier body 31, and may shield at least a portion of the recovery duct. As illustrated in FIG. 2, the barrier cover 33 may be configured to be shorter than the upper surface of the barrier body 31, and may have a kind of empty space in front of the barrier cover. Additionally, such empty space may be a part connected to the duct inlet 16.

A mounting part 34 may protrude on the barrier cover 33. The mounting part 34 may be a part protruding further from the upper part of the barrier cover 33, and in the embodiment, the mounting part 34 may have a shape approximate to a rectangular frame. The mounting part 34 may be the most protruding part on the upper surface of the barrier cover 33, and may be the most protruding part even on the bottom surface 14 of the freezer compartment F1.

Figure 3:
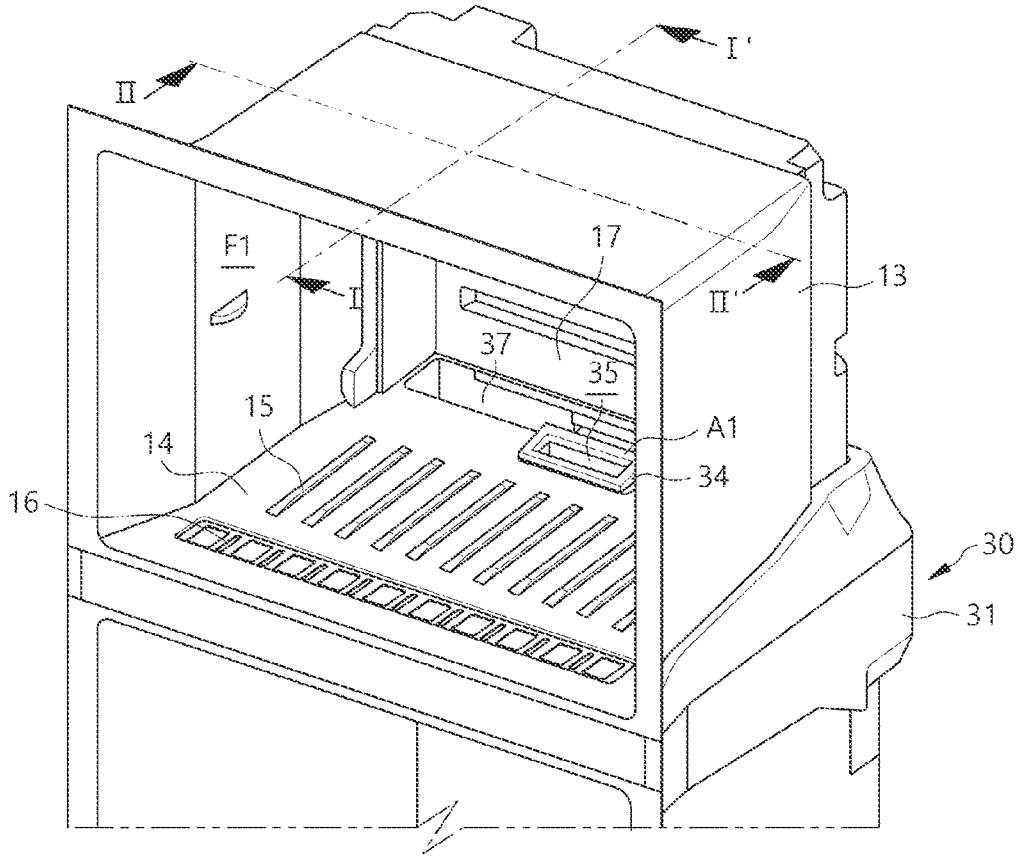
FIG. 3 is an enlarged perspective view of the configuration of a freezer compartment illustrated FIG. 1 according to the embodiment.

More specifically, as illustrated in FIG. 3, when the barrier 30 is assembled with the inner casing 10, a major part of the barrier 30 may be covered by the bottom surface 14 of the freezer compartment F1, but the mounting part 34 of the barrier cover 33 may protrude upward from the bottom surface 14 of the freezer compartment F1. This is because a mounting groove (no reference numeral) may be formed on the bottom surface 14 of the freezer compartment F1 and the mounting part 34 may be disposed in the mounting groove.

In addition, a communication hole 35 may be formed at the center of the mounting part 34. The communication hole 35 may be a part connected to a discharge hole 67 of the grille fan assembly 50, and may be formed vertically through the barrier cover 33.

The communication hole 35 may be formed not only on the barrier cover 33 but also on the barrier body 31. The communication hole 35 may be formed continuously through the barrier cover 33 and the barrier body 31, and may function to transmit air in a vertical direction. More specifically, cold air discharged from the grille fan assembly 50 may be discharged to the discharge hole 67 of the grille fan assembly 50, and may be transmitted to a lower side through the communication hole 35 in contact with the discharge hole 67. Here, the refrigerating compartment F2 may be located at the lower side.

A first inclined part A1 may be formed on the periphery of the communication hole 35. The first inclined part A1 may be formed on the periphery of the communication hole 35 which is the edge of the communication hole 35, and in the embodiment, the first inclined part A1 may be formed on the upper surface of the mounting part 34. The first inclined part A1 may be configured to have height increasing gradually toward the rear of the inner casing 10 directed to the rear plate 17. That is, the first inclined part A1 may have height increasing gradually rearward toward the rear plate 17 from a front side which is the entrance of the freezer compartment F1. The first inclined part A1 may have a flat or curved shape.

The first inclined part A1 may correspond to a second inclined part A2 of the grille fan assembly 50 to be described later. When the grille fan assembly 50 is mounted to the inner casing 10, the second inclined part A2 of the grille fan assembly 50 may climb on the first inclined part A1 such that the first inclined part A1 and the second inclined part A2 are in close contact with each other. Such a structure will be described again below.

Although not shown, the sealing foam may be formed on the first inclined part A1. The sealing foam may be formed by surrounding the edge of the first inclined part A1. The sealing foam may function to prevent cold air from leaking to the surrounding area of the communication hole 35 located at the center of the first inclined part A1. The sealing foam may be made of a material such as rubber, silicone or urethane foam that can be elastically transformed to some extent.

The sealing foam may be located between the first inclined part A1 and the second inclined part A2 of the grille fan assembly 50 to be described later. The sealing foam may be located between the communication hole 35 of the center of the first inclined part A1 and the discharge hole 67 of the center of the second inclined part A2, and may have opposite surfaces thereof compressed by the first inclined part A1 and the second inclined part A2, respectively, so the sealing foam may perform a sealing function.

A drain tray 37 may be disposed on the upper part of the barrier 30. The drain tray 37 may be disposed at the rear of the barrier cover 33 and may be considered as a part of the barrier cover 33. The evaporator may be disposed above the drain tray 37, and defrost water generated at the evaporator may be collected in the drain tray 37 and then may be discharged downward. A heater may be mounted to the drain tray 37 so as to melt frost generated on the evaporator. Reference numeral 38 is a flow path cover and may function to allow cold air recovered by the recovery duct to be transmitted back to the evaporator.

Next, as for the grille fan assembly 50, the grille fan assembly 50 may be disposed at a rear side of the inside of the upper casing 13. The grille fan assembly 50 may be disposed to be spaced apart from the rear plate 17, and thus the evaporation chamber may be formed between the rear plate 17 and the grille fan assembly 50. The evaporator may be provided in the evaporation chamber.

Figure 4:
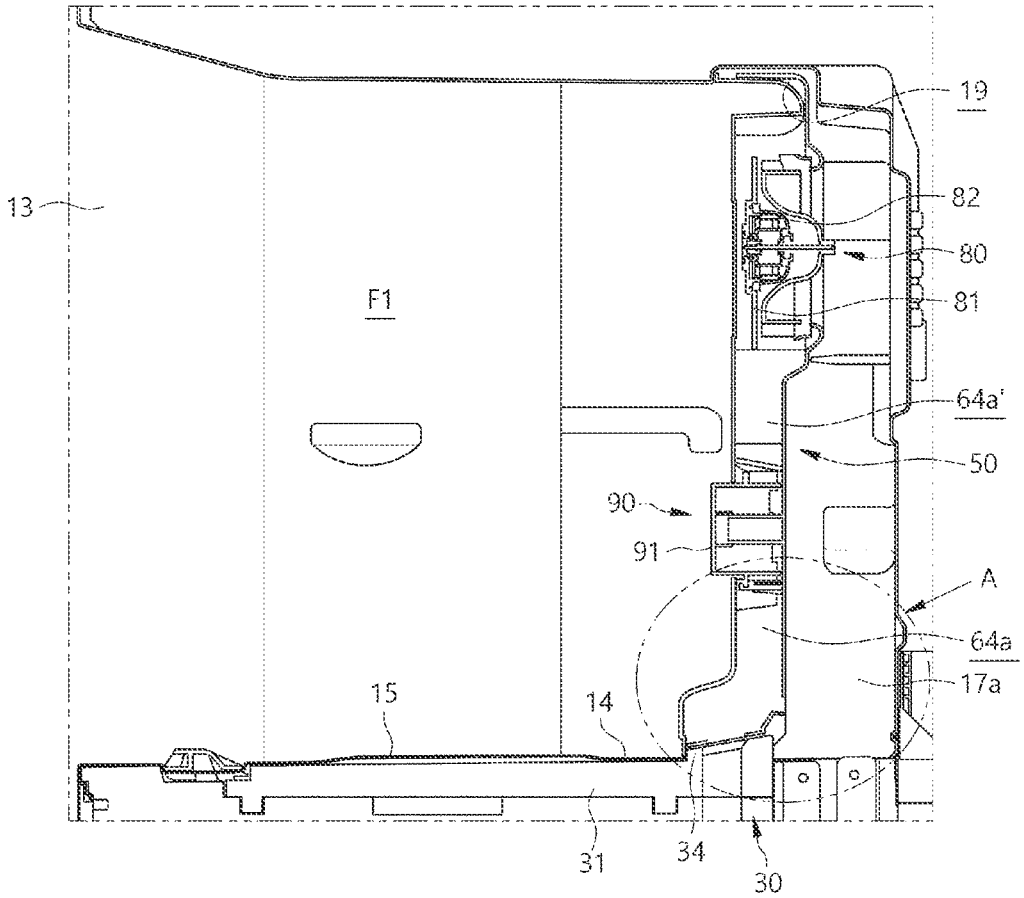
FIG. 4 is a sectional view taken along line I-I' of FIG. 3.

Referring to FIG. 4, the grille fan assembly 50 may be disposed in front of a side part 17*a* of the inner casing 10. The evaporation chamber may be regarded to be placed inside the side part 17*a*. As illustrated in the drawing, the grille fan assembly 50 may be erected at the rear of the freezer compartment F1 and may constitute the rear surface of the freezer compartment F1.

In the embodiment, the grille fan assembly 50 may be assembled from the front of the upper casing 13 to the rear thereof. In the assembly process of the grille fan assembly 50, the grille fan assembly 50 may interfere with the inner surface of the upper casing 13, that is, the inner surface of the freezer compartment F1. When the grille fan assembly 50 interferes with the inner surface of the upper casing 13, the grille fan assembly 50 may be damaged or the sealing foam may be removed. This may be prevented by the second inclined part A2 of the grille fan assembly 50 in cooperation with the first inclined part A1.

Referring to FIGS. 5 to 8, the second inclined part A2 may be formed on the lower part of the grille fan assembly 50. The second inclined part A2 may be formed on a first housing 60 of the grille fan assembly 50 to be described later. A lower plate 66 may be provided on the lower part of the first housing 60, and the second inclined part A2 may be formed on the lower surface of the lower plate 66. For reference, in the embodiment, the entirety of the lower plate 66 may be the second inclined part A2. That is, the lower plate 66 may be the second inclined part A2.

The discharge hole 67 may be formed in the center of the second inclined part A2. The discharge hole 67 may be formed vertically through the second inclined part A2, and may be connected with the communication hole 35 by being in contact therewith. The discharge hole 67 may be open toward a storage compartment which is the refrigerating compartment F2, and cold air discharged by a blower fan 80 of the grille fan assembly 50 may be transmitted to the storage compartment.

The second inclined part A1 may extend by having a predetermined angle. More specifically, relative to a front-to-rear direction which is a direction orthogonal to a vertical direction in which the grille fan assembly 50 erects in the upper casing 13, the second inclined part A1 may be configured to have height increasing gradually toward the rear of the upper casing 13. Here, the front-to-rear direction may be the same as the depth direction of the freezer compartment F1. The second inclined part A2 may have a flat or curved shape.

The second inclined part A1 may correspond to the first inclined part A1 formed on the periphery of the communication hole 35. While the grille fan assembly 50 is mounted to the upper casing 13, the second inclined part A2 may move along the first inclined part A1. Since each of the first inclined part A1 and the second inclined part A2 may have the structure of a corresponding inclined surface, the second inclined part A2 may naturally move along the first inclined part A1.

More specifically, the grille fan assembly 50 may be mounted to the upper casing 13 by rotating the lower end of the grille fan assembly 50 in a state in which the upper end of the grille fan assembly 50 is first fitted into a holding groove 19 (see FIG. 4) located at the upper part of the upper casing 13. Accordingly, the lower end of the grille fan assembly 50 may be rotated such that the second inclined part A2 located on the lower part of the grille fan assembly 50 is in contact with the first inclined part A1 formed on the barrier 30.

Without the first inclined part A1 and the second inclined part A2, in the process in which the lower end of the grille fan assembly 50 is rotating, the lower surface of the lower end of the grille fan assembly 50 may interfere with the bottom surface of the upper casing 13 or the upper surface of the barrier 30. Additionally, due to such interference, the sealing foam may be removed or may move away from an initial position. However, in the embodiment, this may be prevented by the first inclined part A1 and the second inclined part A2.

Figure 5:
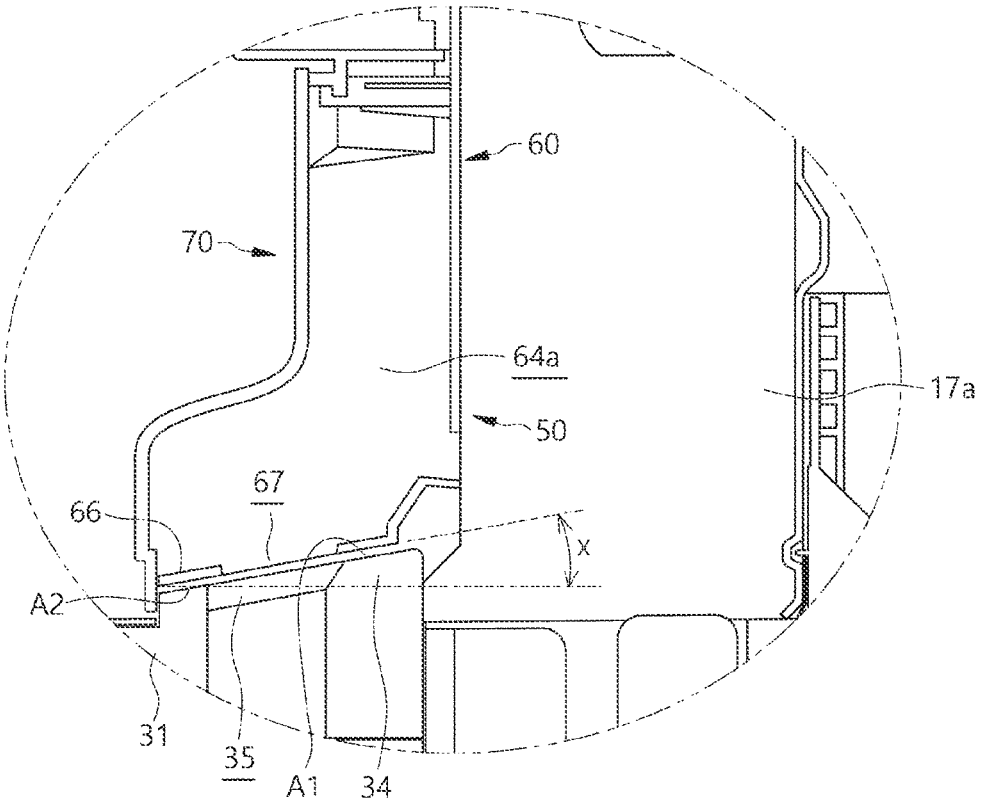
FIG. 5 is an enlarged view of an A part of FIG. 4.

Referring to FIG. 5, the first inclined part A1 and the second inclined part A2 are illustrated to have the same angles. The first inclined part A1 and the second inclined part A2 may be configured to be inclined upward by predetermined angles toward the rear of the upper casing 13 relative to the front-to-rear direction (a side-to-side direction relative to FIG. 5) which is the depth direction of the freezer compartment F1. The first inclined part A1 and the second inclined part A2 preferably have the same inclination angles. This is because when the first inclined part A1 and the second inclined part A2 have inclination angles different from each other, a gap may occur between the first inclined part A1 and the second inclined part A2 and thus cold air may leak to the gap.

In the embodiment, each of the first inclined part A1 and the second inclined part A2 may be configured to have an inclination angle of 5° to 30°. When the inclination angle is 5° or less, the grille fan assembly 50 may interfere with the upper casing 13 during the rotation of the grille fan assembly 50, and when the inclination angle is 30° or more, the lower end of the grille fan assembly 50 may not be held on the upper surface of the first inclined part A1, that is, on the upper surface of sealing foam and may slide forward and thus may have an increased probability of being removed from the upper surface.

Figure 6:
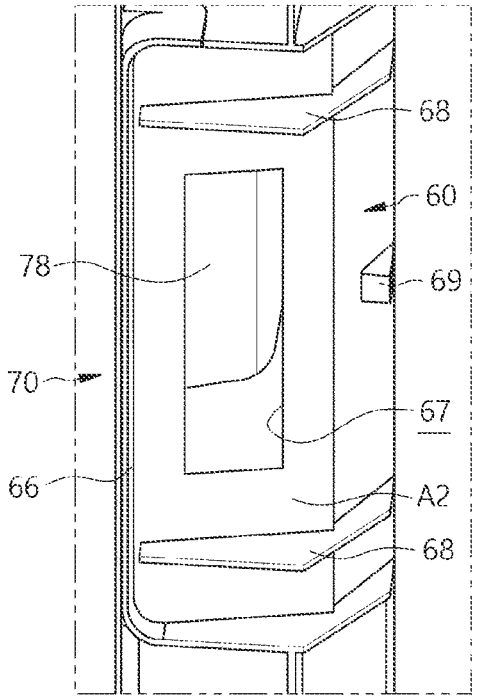
FIG. 6 is a perspective view illustrating the structure of a lower part of the grille fan assembly constituting the refrigerator according to the embodiment of the present disclosure.
Figure 7:
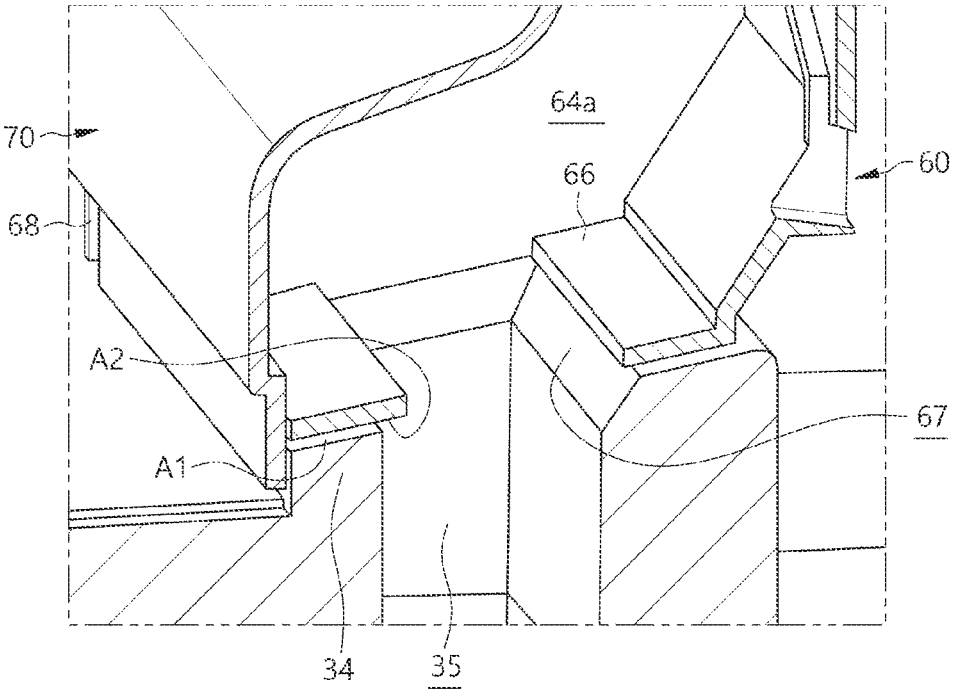
FIG. 7 is a sectional view illustrated by enlarging a connection portion between the grille fan assembly and the barrier constituting the refrigerator according to the embodiment of the present disclosure.
Figure 8:
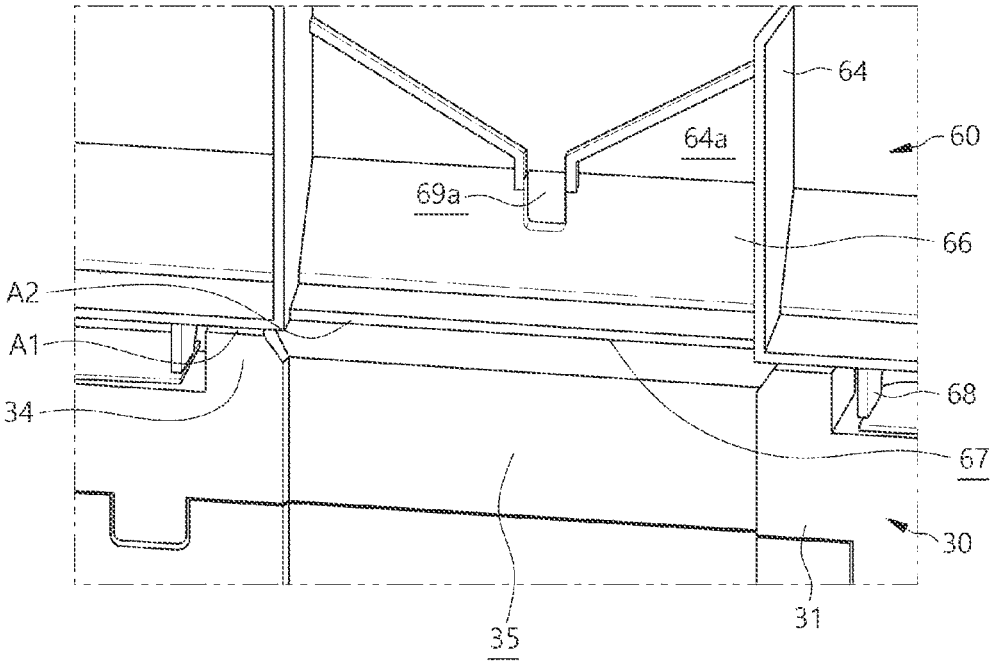
FIG. 8 is a sectional view illustrating the connection portion between the grille fan assembly and the barrier, seen from an angle different from FIG. 7, constituting the refrigerator according to the embodiment of the present disclosure.

Referring to FIG. 6, a guide rib 68 may protrude on each of the opposite sides of the second inclined part A2. The guide rib 68 may be formed on the lower surface of the grille fan assembly 50 adjacent to the second inclined part A2. When the grille fan assembly 50 is mounted to the upper casing 13, the pair of guide ribs 68 may surround the periphery of the first inclined part A1. The guide rib 68 may surround the periphery of the first inclined part A1 and may guide the first inclined part A1 and the second inclined part A2 such that the first inclined part A1 and the second inclined part A2 may face each other at precise positions, respectively. This state is illustrated in FIGS. 7 and 8.

Since the first inclined part A1 and the second inclined part A2 have inclining shapes, the communication hole 35 and the discharge hole 67 may also be configured in inclining directions. Since the communication hole 35 and the discharge hole 67 are configured in the inclining directions, the area of the flow path entrance may increase compared to a flow path entrance having a planar shape. Accordingly, the amount of cold air transmitted to the refrigerating compartment F2 may further increase and the flow of the cold air may further be facilitated.

In the embodiment, when the grille fan assembly 50 is mounted to the upper casing 13, most of the lower surface of the grille fan assembly 50 may be in close contact with the barrier cover 33 alone. Particularly, the grille fan assembly 50 may be mounted to the upper casing 13 in such a manner that the second inclined part A2 constituting the lower surface of the grille fan assembly 50 moves along the sealing foam formed on the first inclined part A1 of the barrier cover 33 and presses the sealing foam.

Next, the grille fan assembly 50 will be described in detail with reference to FIGS. 9 to FIG. 12. As described above, the grille fan assembly 50 may function to discharge the cold air of the evaporator toward the freezer compartment F1 and the refrigerating compartment F2, and further, may function to separate the freezer compartment F1 from the evaporation chamber.

Figure 9:
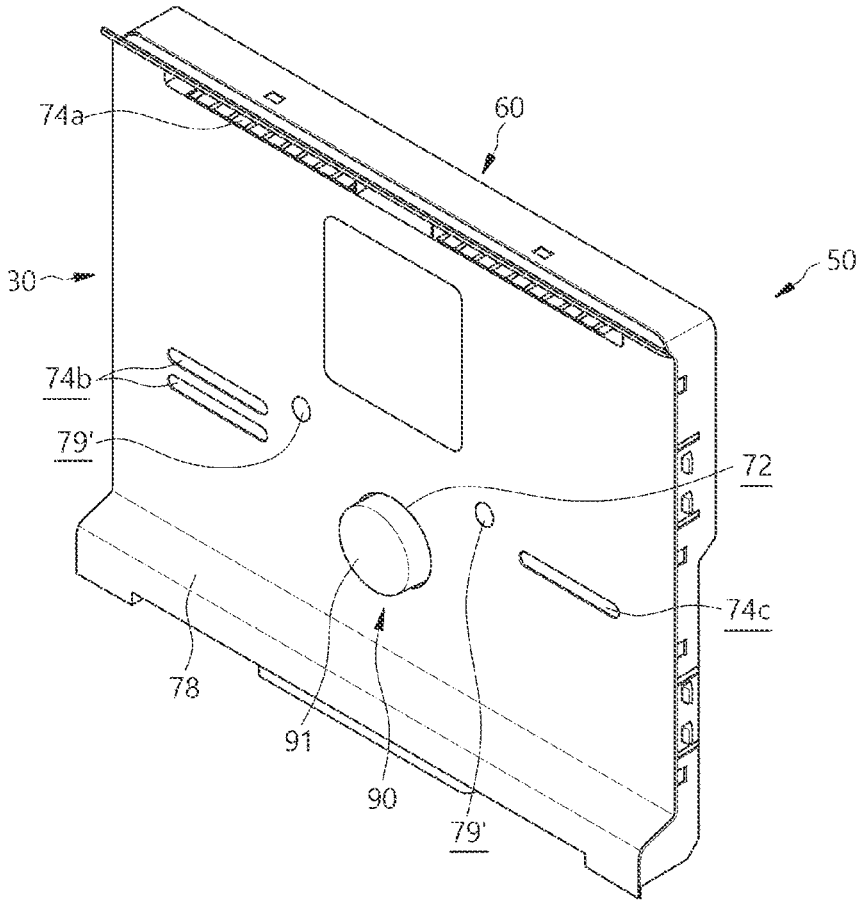
FIG. 9 is a perspective view illustrating the configuration of the grille fan assembly constituting the refrigerator according to the embodiment of the present disclosure.

FIG. 9 illustrates the grille fan assembly 50 such that the front surface of the grille fan assembly is exposed to the outside. The grille fan assembly 50 may be composed of multiple parts. In FIG. 9, the front surface of a second housing 70 of the grille fan assembly 50 is illustrated to be directed forward. The frame of the grille fan assembly 50 may be largely composed of the first housing 60 and the second housing 70. The first housing 60 may constitute the rear surface of the grille fan assembly 50, and the second housing 70 may constitute the front surface of the grille fan assembly 50. The first housing 60 may be referred to as a shroud, and the second housing 70 may be referred to as a grille fan.

A portion of a control knob 90 may be exposed to the front surface of the grille fan assembly 50. A knob opening part 72 may be formed at the center of the second housing 70 such that a portion of the control knob 90 protrudes through the knob opening part. In the embodiment, a knob body 91 of the control knob 90 may have a cylindrical shape. As illustrated in the drawings, the dial-shaped knob body 91 may protrude forward. A user may grip the exposed part of the knob body 91 and may rotate the knob body 91 clockwise or counterclockwise. Accordingly, the amount of cold air discharged into the freezer compartment F1 may be controlled.

Figure 10:
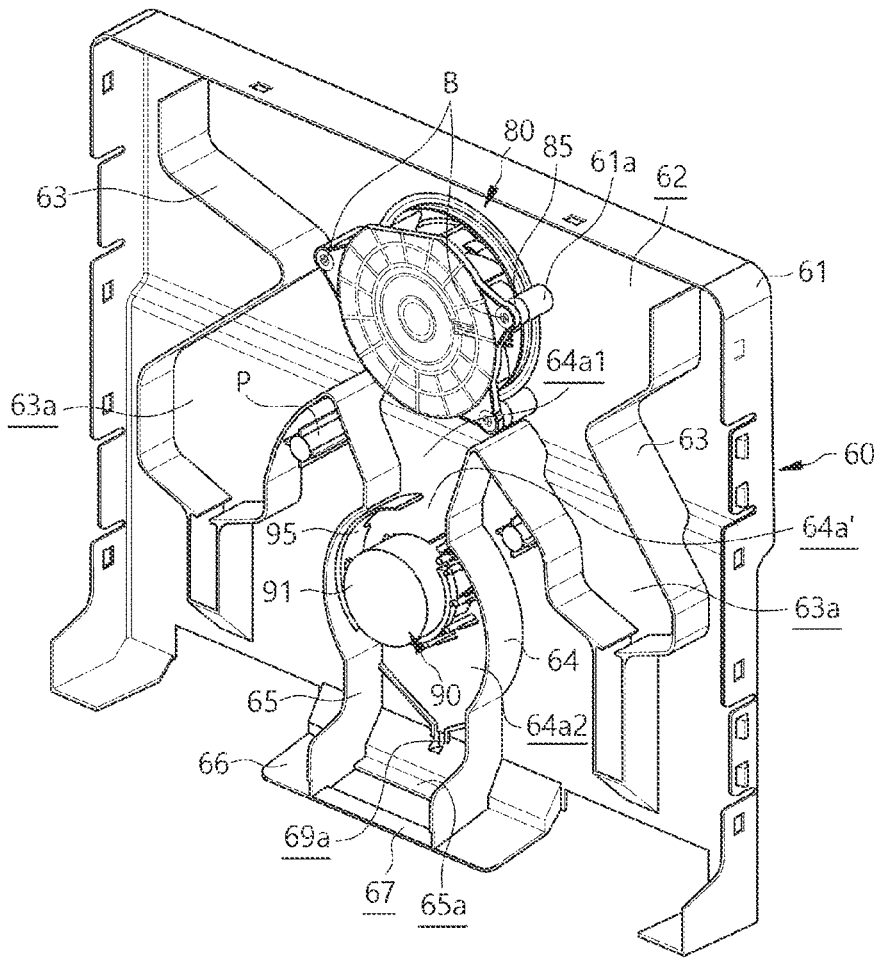
FIG. 10 is a perspective view illustrating a state in which a grille fan and a control knob are assembled with a first housing constituting the grille fan assembly of FIG. 9.

FIG. 10 illustrates the state of the grille fan assembly 50 from which the second housing 70 is removed. As illustrated in the drawing, the first housing 60 may be disposed behind the second housing 70, and the blower fan 80 and the control knob 90 may be disposed in the first housing 60. More specifically, each of the blower fan 80 and the control knob 90 may be considered to be disposed between the first housing 60 and the second housing 70.

The blower fan 80 may be configured as a module provided with a fan and a motor. When the blower fan 80 operates, cold air may be introduced from the evaporator. Additionally, the introduced cold air may move along a flow path for the freezer compartment (a freezer flow path 63*a*) and the flow path for the refrigerating compartment (a refrigeration flow path 64*a*1 and 64*a*2) which are provided in the first housing 60, and may be supplied to the freezer compartment F1 and the refrigerating compartment F2.

Figure 11:
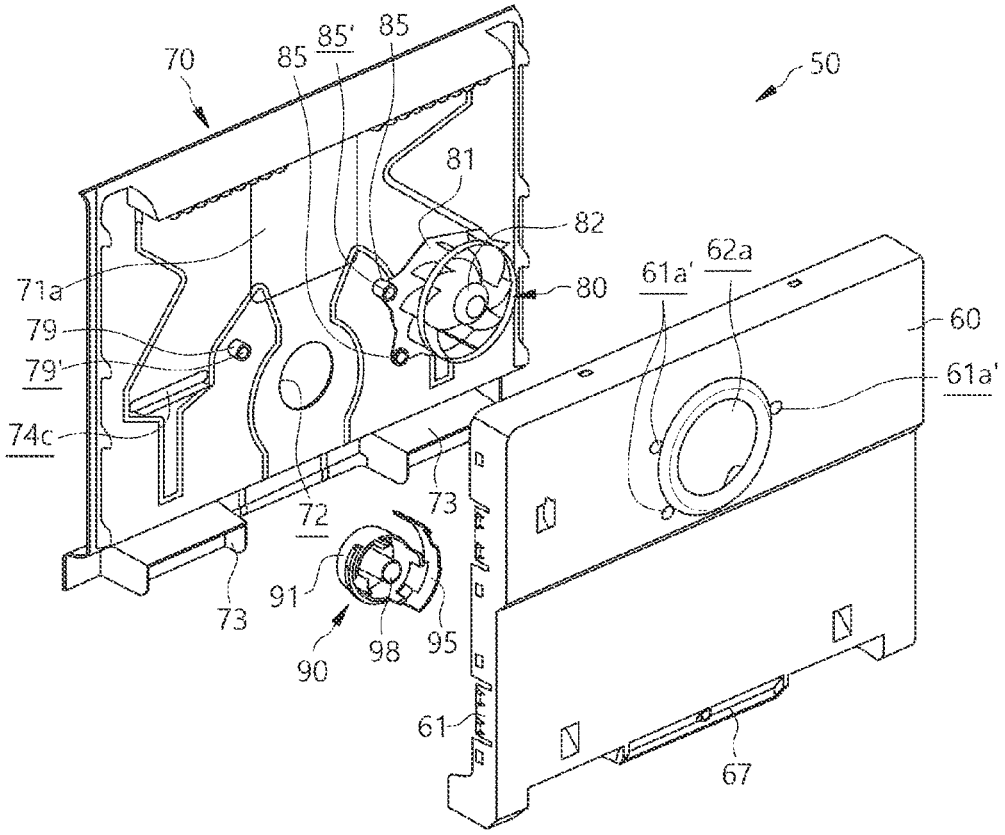
FIG. 11 is an exploded perspective view of the configuration of the grille fan assembly constituting the refrigerator according to the embodiment of the present disclosure.
Figure 12:
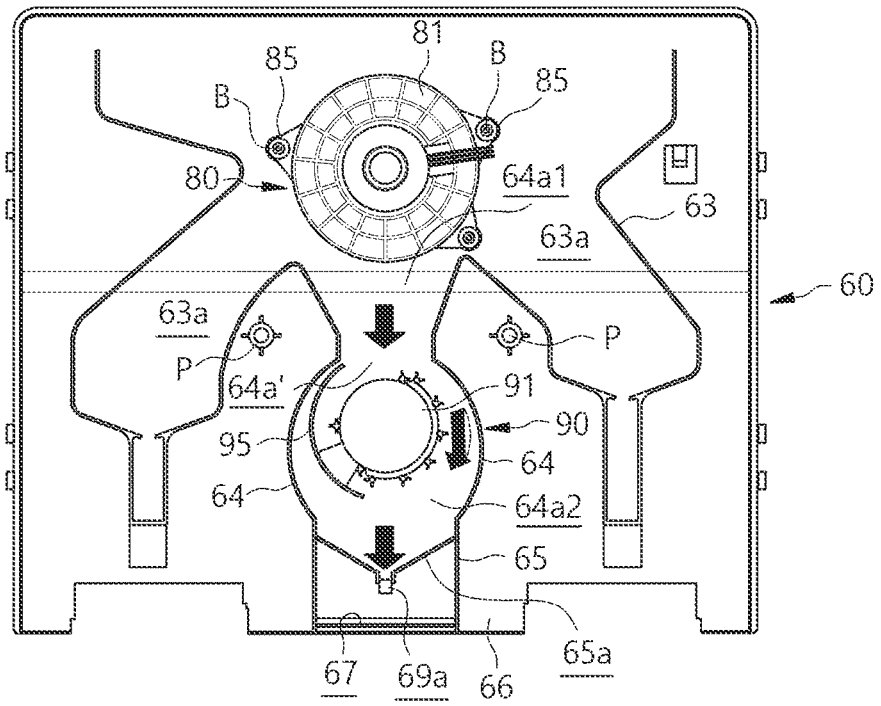
FIG. 12 is a front view illustrating the state in which the grille fan and the control knob are assembled with the first housing constituting the grille fan assembly of FIG. 9.

Referring to FIG. 11, the blower fan 80 may include a mounting body 81 and a fan 82 mounted to the mounting body 81. The blower fan 80 may be mounted to a fan opening part 62*a* formed through the first housing 60. The fan opening part 62*a* may be open even toward the evaporation chamber, so the cold air of the evaporation chamber may be introduced into a flow space 62 by the blower fan 80.

As illustrated in FIGS. 10 and 11, the mounting body 81 may be provided with a mounting flange 85, and a mounting boss 61*a* corresponding to the mounting flange 85 may protrude on the first housing 60. When the mounting flange 85 and the mounting boss 61*a* are stacked on each other, a flange hole 85' formed through the mounting flange 85 and a boss hole 61*a'* formed through the mounting boss 61*a* may be connected to each other. In this state, when a fastener B passes continuously through the flange hole 85' and the boss hole 61*a'*, the blower fan 80 may be mounted to the first housing 60.

In the embodiment, the mounting flange 85 may include a total of three mounting flanges provided on the mounting body 81, and the mounting boss 61*a* may also include a total of three mounting bosses provided on the first housing 60. As illustrated in FIG. 10, relative to the center of the blower fan 80, one of the three mounting flanges 85 may be disposed at the left side, and two of the three mounting flanges 85 may be disposed at the right side. The mounting flange 85 is required not to obstruct the path of cold air discharged by the blower fan 80 and is preferably disposed at a position away from the freezer flow path 63*a* and the entrance of the refrigeration flow path 64*a*1 and 64*a*2.

In the embodiment, the mounting flange 85 at the left side may be disposed above the entrance of the freezer flow path 63*a* located at the left side, and the two mounting flanges 85 at the right side may be disposed to be spaced apart from the entrance of the freezer flow path 63*a* located at the right side such that the two mounting flanges 85 do not interfere with the entrance of the freezer flow path 63*a*. The number and positions of the mounting flanges 85 and the mounting bosses 61*a* may be changed.

A fence part 61 may be provided on the edge of the first housing 60. The fence part 61 may have a shape bent from the edge of the first housing 60 forward toward the second housing 70. The fence part 61 may be formed along the edge of the first housing 60, and the flow space 62 which is empty space may be defined inside the fence part 61.

The flow space 62 of the first housing 60 may be provided with flow guides 63 and 64. The flow guides 63 and 64 may protrude on the front surface of the first housing 60 (or on the rear surface 71*a* of the second housing 70). The flow guides 63 and 64 may be a part at which the cold air outlets 74*a*, 74*b*, and 74*c* of the second housing 70 are formed, and may include a flow guide 63 for the freezer compartment guiding the flow of cold air to the freezer compartment, and a flow guide 64 for the refrigerating compartment guiding the flow of cold air to the refrigerating compartment F2.

As illustrated in FIG. 10, the flow guide 63 for the freezer compartment may be disposed at each of the opposite sides of the flow guide 64 for the refrigerating compartment. The freezer flow path 63*a* may be formed inside the flow guide 63 for the freezer compartment, and may be connected to the cold air outlets 74*a*, 74*b*, and 74*c* of the second housing 70.

The refrigeration flow path 64*a*1 and 64*a*2 which is the flow path for the refrigerating compartment may be formed inside the flow guide 64 for the refrigerating compartment. Furthermore, the refrigeration flow path 64*a*1 and 64*a*2 may include an upper flow path 64*a*1 configured to receive cold air blown by the blower fan 80, and a lower flow path 64*a*2 having a width increasing while extending downward from the upper flow path 64*a*1. In addition, the opening/closing entrance 64*a'* may be disposed between the upper flow path 64*a*1 and the lower flow path 64*a*2.

Here, the upper flow path 64*a*1 may be located under the blower fan 80. Accordingly, in cold air discharged in a spiral direction due to the rotation of the blower fan 80, cold air discharged toward the lower side of the blower fan 80 may flow to the upper flow path 64*a*1 of the flow guide 64 for the refrigerating compartment. In the embodiment, the entrance of the upper flow path 64*a*1 may be located directly under the blower fan 60. Alternatively, the entrance of the upper flow path 64*a*1 may not be disposed directly under the blower fan 80, but may be disposed at a position skewed to the left or right side from a position directly under the blower fan 80.

Meanwhile, the upper flow path 64*a*1 of the flow guide 64 for the refrigerating compartment may be configured to have a width decreasing gradually toward the opening/closing entrance 64*a'* of the refrigeration flow path 64*a*1 and 64*a*2. Through the structure of such an upper flow path 64*a*1, cold air blown by the blower fan 80 may be efficiently transmitted to the refrigerating compartment F2.

In addition, the flow guide 64 for the refrigerating compartment may further include an exit part 65 formed by extending downward from the lower flow path 64*a*2 and communicating with the refrigerating compartment F2. An exit flow path 65*a* may be formed inside the exit part 65.

Furthermore, the lower plate 66 of the first housing 60 may be provided on the lower end portion of the exit part 65. The lower plate 66, together with the exit part 65, may form the exit flow path 65*a*. Additionally, the discharge hole 67 formed in the lower plate 66 may be connected to the exit flow path 65*a*, and may allow cold air of the exit flow path 65*a* to be discharged downward, more specifically, to the refrigerating compartment F2.

A condensate drain hole 69*a* may be formed in a part at which the exit flow path 65*a* is formed. The condensate drain hole 69*a* may be formed through the first housing 60 in a front-to-rear direction. The condensate drain hole 69*a* is intended to discharge a condensate flowing along the refrigeration flow path 64*a*1 and 64*a*2 to the outside. Referring to FIG. 6, a condensate guide 69 may protrude from the rear surface of the first housing 60, and the condensate drain hole 69*a* may be formed inside the condensate guide 69.

Water, together with cold air, may flow in the refrigeration flow path 64*a*1 and 64*a*2 formed by the flow guide 64 for the refrigerating compartment. Water flowing in the refrigeration flow path 64*a*1 and 64*a*2 may not supplied to the refrigerating compartment F2, but may be discharged to the outside of the grille fan assembly 50 by the condensate drain hole 69*a*, for example, to the drain tray 37.

The discharge hole 67 may be formed in the lower plate 66. Additionally, the second inclined part A2 described above may be formed on the lower surface of the lower plate 66 by surrounding the periphery of the discharge hole 67. In the embodiment, the entirety of the lower plate 66 may extend to be inclined in a front-to-rear direction, so the lower plate 66 may be the second inclined part A2. Alternatively, as the thickness of the lower plate changes in the front-to-rear direction, the second inclined part A2 may be formed on the lower surface of the lower plate 66.

In this case, the lower plate 66 may be configured individually by being separated from the opposite side surfaces of the first housing 60. That is, a predetermined empty space may be defined between the lower plate 66 and each of the opposite side surfaces of the first housing 60, and the lower plate 66 may have a kind of cantilever structure by protruding from the lower end of the first housing 60. In this case, the lower plate 66 may be elastically transformed more freely. Accordingly, when mounting the grille fan assembly 50 to the upper casing 13, the lower plate 66 may be elastically transformed more efficiently while being guided by the first inclined part A1.

Referring to FIG. 13A, an adjustment jaw G may be formed on the inner surface of the first housing 60. The adjustment jaw G may protrude from the inner surface of the first housing 60 in a direction toward the rear surface 71*a* of the second housing 70. The adjustment jaw G may be fitted into each of control recesses 93 of the control knob 90 to be describe later. When the adjustment law G is fitted into the control recess 93, the control knob 90 may be held at a specific angle.

As illustrated in FIG. 13B, the adjustment jaw G may include a plurality of adjustment jaws. The plurality of adjustment jaws G may be disposed with predetermined radii of curvature to each other. The plurality of adjustment jaws G may be fitted into the control recesses 93, respectively, or some of the control recesses 93. Unlike the embodiment, the adjustment jaw G may include only one adjustment jaw instead of the plurality of adjustment jaws, and the one adjustment jaw G may be fitted into each of different control recesses 93 to hold the angle of the control knob 90.

The adjustment jaw G may have a cantilever structure protruding from the inner surface of the first housing 60, and may have a cylindrical shape. Alternatively, the adjustment jaw G may protrude from the rear surface 71*a* of the second housing 70.

A stopper ST1 and ST2 may protrude on the inner surface of the first housing 60. The stopper ST1 and ST2 may be intended to limit the maximum rotation angle of the control knob 90, and may interfere with the control knob 90. The stopper ST1 and ST2 may have a cylindrical shape protruding from the inner surface of the first housing 60 like the adjustment jaw G.

In the embodiment, the stopper ST1 and ST2 may interfere with the side surface of the connection arm 94 of the control knob 90. When the stopper ST1 and ST2 interferes with the side surface of the connection arm 94, the maximum rotation angle of the control knob 90 may be limited.

The stopper ST1 and ST2 may be composed of a pair of stoppers. In the embodiment, the stopper ST1 and ST2 may be composed of a first stopper ST1 and a second stopper ST2 spaced apart from each other such that the first stopper ST1 and the second stopper ST2 limit the maximum and minimum opening angles of the control knob 90, respectively. For reference, in FIG. 13B, the control knob 90 may rotate at the maximum opening angle, so the first stopper ST1 may interfere with the first side surface of the connection arm 94, and in FIG. 14B, the control knob 90 may rotate at the minimum opening angle, so the second stopper ST2 may interfere with the second side surface of the connection arm 94.

In the embodiment, the stopper ST1 and ST2 may have a protruding length shorter than the protruding length of the adjustment jaw G. More specifically, the stopper ST1 and ST2 may be configured to be shorter than a distance by which an angle adjustment part 92 of the control knob 90 to be described later is spaced apart from the inner surface of the first housing 60, so the stopper ST1 and ST2 may not interfere with the angle adjustment part 92. In addition, the stopper ST1 and ST2 may be configured to be longer than a distance by which the connection arm 94 of the control knob 90 is spaced apart from the inner surface of the first housing 60, so the stopper ST1 and ST2 may interfere with the connection arm 94.

Looking at the second housing 70 with reference to FIGS. 9 and FIG. 11, the second housing 70 may have a structure of a flat plate corresponding to the first housing 60. The second housing 70 and the first housing 60 may be coupled to each other and the flow space 62 shielded therein may be defined.

A first coupling end part 71 may protrude on the upper end of the second housing 70. The first coupling end part 71 may be in close contact with the inside of the fence part 61 provided on the upper end of the first housing 60. Furthermore, a second coupling end part 73 may protrude on the lower end of the second housing 70. The second coupling end part 73 may fill empty space defined between each of the opposite side surfaces of the first housing 60 and the lower plate 66.

All of the flow guide 63 for the freezer compartment and the flow guide 64 for the refrigerating compartment described above may be formed in the first housing 60, but alternatively, at least one of the flow guide 63 for the freezer compartment and the flow guide 64 for the refrigerating compartment may protrude from the rear surface 71*a* of the second housing 70.

As illustrated in FIG. 9, a plurality of cold air outlets 74*a*, 74*b*, and 74*c* may be formed in the front surface of the grille fan assembly 50. The cold air outlets 74*a*, 74*b*, and 74*c* are intended to supply the cold air of the evaporation chamber into the freezer compartment F1. The cold air outlets 74*a*, 74*b*, and 74*c* may be formed through positions corresponding to the flow guide 63 for the freezer compartment of the first housing 60 to be described below.

The cold air outlet 74*a*, and the cold air outlets 74*b* and 74*c* may be formed at the upper part and middle part, respectively, of the second housing 70. In the embodiment, the upper cold air outlet 74*a* may be formed in the upper part of the second housing 70, and the left cold air outlet 74*b* and the right cold air outlet 74*c* may be formed at the middle part thereof and at the left and right sides, respectively, relative to the control knob 90.

A lower jaw 78 may protrude on the lower end of the second housing 70. The lower jaw 78 may protrude toward the entrance of the freezer compartment F1, and may be formed continuously along the lower end of the second housing 70. The lower jaw 78 may increase the width of the exit flow path 65*a*, and may allow the position of the discharge hole 67 to be biased toward the entrance of the freezer compartment F1. Referring to FIG. 5, the position of the discharge hole 67 can be seen to be located at a position forward (the left side relative to the drawing) more than the lower flow path 64*a*2 located above the discharge hole 67.

The first housing 60 and the second housing 70 may be coupled to each other by various methods such as a fastener (not shown), laser welding or adhesive. In the embodiment, a fastening protrusion part 79 may be formed on the second housing 70, and a fastening hole 79' may be formed in the center of the fastening protrusion part 79.

In addition, a fastening boss P may protrude on the first housing 60 such that the fastening boss P is located at a position facing the fastening protrusion part 79. The fastening boss P may be formed at a position away from the freezer flow path 63*a* and the refrigeration flow path 64*a*1 and 64*a*2 such that the fastening boss P does not interfere with the freezer flow path 63*a* and the refrigeration flow path 64*a*1 and 64*a*2.

In a state in which the fastening protrusion part 79 and the fastening boss P face each other, when the fastener (not shown) passes through the fastening hole 79' and is fastened to the fastening boss P, the first housing 60 and the second housing 70 may be assembled with each other.

The first housing 60 and the second housing 70 may be coupled to each other by various methods such as a fastener, laser welding, or adhesive. In the embodiment, the fastening protrusion part 79 may be formed on the second housing 70, and a separate fastening boss P may be engaged with the fastening protrusion part 79 such that the first housing 60 and the second housing 70 are coupled to each other.

Next, the control knob 90 mounted to the grille fan assembly 50 will be described. The control knob 90 may open and close the opening/closing entrance 64*a*' of the refrigeration flow path 64*a*1 and 64*a*2 by being rotated. More specifically, the opening/closing entrance 64*a*' located at a boundary between the upper flow path 64*a*1 and the lower flow path 64*a*2 constituting the refrigeration flow path 64*a*1 and 64*a*2 may be opened and closed by the control knob 90.

Here, the opening and closing of the opening/closing entrance 64*a*' may include the complete closing or opening of the opening/closing entrance 64*a*' and the partial closing or opening of the opening/closing entrance 64*a*'.

The control knob 90 may be mounted to the grille fan assembly 50, and in the embodiment, may be mounted to be rotatable relative to a rotating shaft configured in the same direction as the rotating shaft of the blower fan 80. That is, the control knob 90 may be installed in an upright direction rather than in a lying direction. Accordingly, as illustrated in FIG. 9, the control knob 90 may be exposed to a user in the form of a cylindrical dial. In this case, a user may rotate the control knob 90 more intuitively. Additionally, a user may control the temperature of the freezer compartment F1 by turning the control knob having the shape of the cylindrical dial, so the user may more accurately recognize the state of the control knob which the user manipulated.

Particularly, when a user manipulates the control knob 90, the user may cover and grip the outer circumferential surface of the cylindrical control knob 90. That is, a user may grip the control knob 90 by simultaneously using multiple fingers, so the user may accurately grip the control knob 90 without sliding.

In addition, when the control knob 90 is mounted to the grille fan assembly 50 in an upright direction rather than in a lying direction, the front-to-rear directional width of the control knob 90 which the control knob 90 occupies in the grille fan assembly 50 may decrease.

The control knob 90 may be provided in the grille fan assembly 50, and may control the amount of cold air blown to the discharge hole 67 through the rotation angle of the control knob 90. The amount of the cold air transmitted to the refrigerating compartment F2 through the discharge hole 67 may be controlled according to the rotation angle of the control knob 90, and accordingly, the temperature control of the freezer compartment F1 may be performed.

To this end, the control knob 90 may be disposed in the refrigeration flow path 64*a*1 and 64*a*2 formed inside the grille fan assembly 50. More specifically, the control knob 90 may be installed to be adjacent to the opening/closing entrance 64*a*' of the refrigeration flow path 64*a*1 and 64*a*2. Furthermore, an opening/closing blade 95 of the control knob may open and close the opening/closing entrance 64*a*' of the flow path for the refrigerating compartment.

Specifically, the frame of the control knob 90 may be constituted by the cylindrical knob body 91. At least a portion of the knob body 91 may protrude from the grille fan assembly 50 toward the front of the freezer compartment F1, and the protruding part may be a gripping part.

Figure 15:
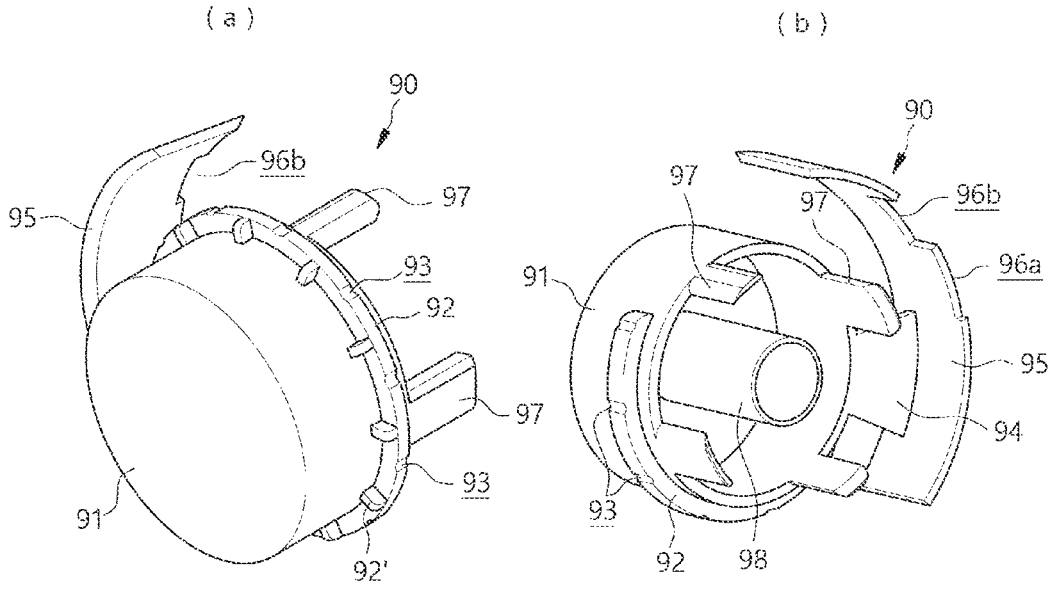
FIGS. 15A and 15B are perspective views, seen from angles different from each other, of the configuration of the control knob constituting the refrigerator according to the embodiment of the present disclosure.

Referring to FIG. 15, the angle adjustment part 92 may be formed on the outer circumferential surface of the knob body 91. The angle adjustment part 92 may protrude from the outer circumferential surface of the knob body 91, and may interfere with the adjustment jaw G protruding from the first housing 60.

The angle adjustment part 92 may be formed continuously along the outer circumferential surface of the knob body 91. In the embodiment, the angle adjustment part 92 may have a structure approximate to a thin band shape, and the control recess 93 may be recessed on the surface of the angle adjustment part 92. The adjustment jaw G may be fitted into the control recess 93 such that the angle of the control knob 90 may be fixed. The control recess 93 may include multiple control recesses formed along the angle adjustment part 92, and intervals between the control recesses may correspond to the plurality of adjustment jaws G.

A close-contact protrusion part 92' may be formed on the angle adjustment part 92. The close-contact protrusion part 92' may protrude from the angle adjustment part 92 toward the rear surface 71*a* of the second housing 70. When the control knob 90 is mounted to the grille fan assembly 50, the close-contact protrusion part 92' may be in close contact with the rear surface 71*a* of the second housing 70 and may function to decrease a gap between the rear surface 71*a* of the second housing 70 and the control knob 90.

Figure 16:
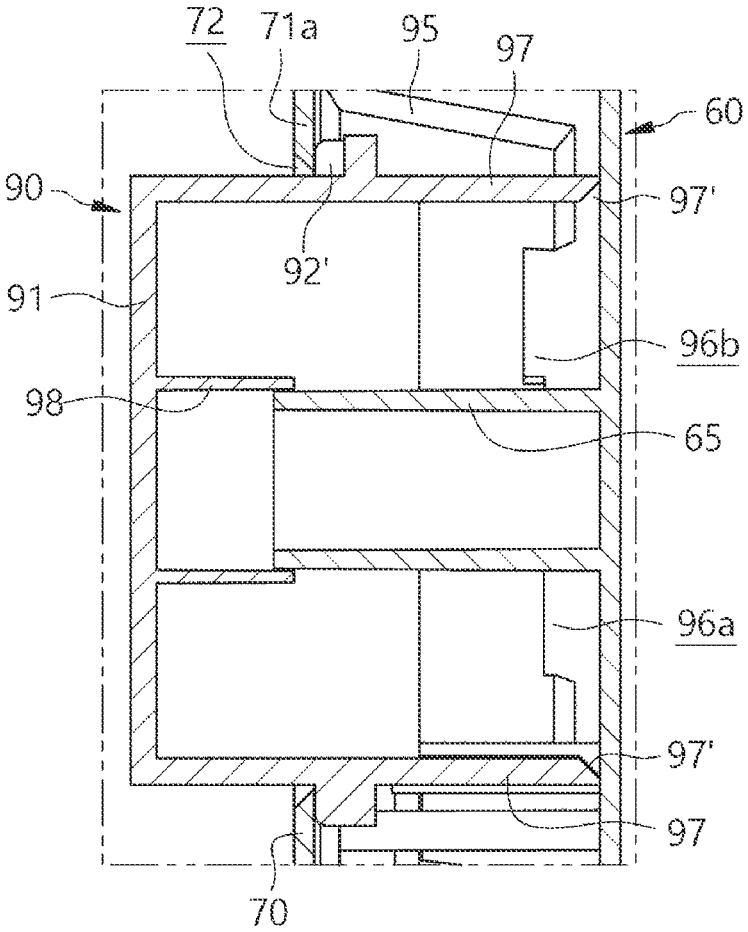
FIG. 16 is a sectional view illustrating a state in which the control knob constituting the refrigerator is mounted to the grille fan assembly according to the embodiment of the present disclosure.

This state is illustrated in FIG. 16. For reference, the close-contact protrusion part 92' may be in close contact with the rear surface 71*a* of the second housing 70 which is an opposing inner surface facing the inner surface of the first housing 60 with which support legs 97 to be described later are in close contact.

The connection arm 94 may protrude on the outer circumferential surface of the knob body 91, and the opening/closing blade 95 may be provided on the connection arm 94. The opening/closing blade 95 may have a diameter larger than the diameter of the knob body 91, and may function to substantially close or open the opening/closing entrance 64*a*'.

As described above, the connection arm 94 may interfere with the stopper ST1 and ST2 of the first housing 60 and may function to limit the maximum rotation angle of the control knob 90. Specifically, as illustrated in FIG. 13B, the control knob 90 may rotate at the maximum opening angle, so the first stopper ST1 may interfere with the first side surface of the connection arm 94, and as illustrated in FIG. 14B, the control knob 90 may rotate at the minimum opening angle, so the second stopper ST2 may interfere with a second side surface of the connection arm 94.

Figure 13:
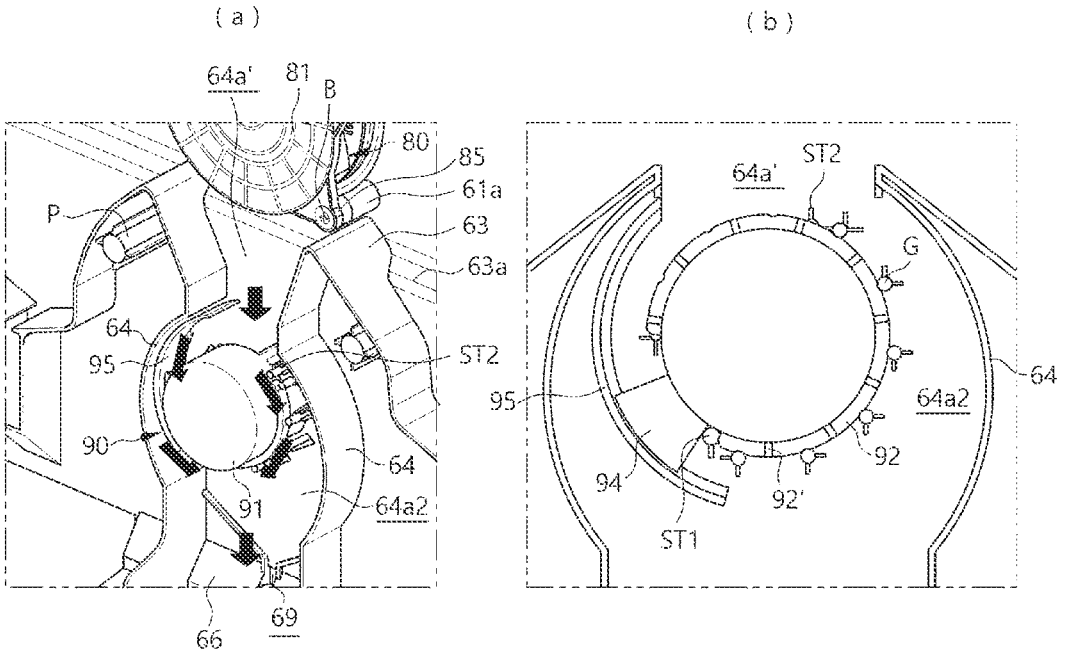
FIGS. 13A and 13B are a perspective view and a front view, respectively, illustrating the maximum opened states of the control knob constituting the refrigerator according to the embodiment of the present disclosure.
Figure 14:
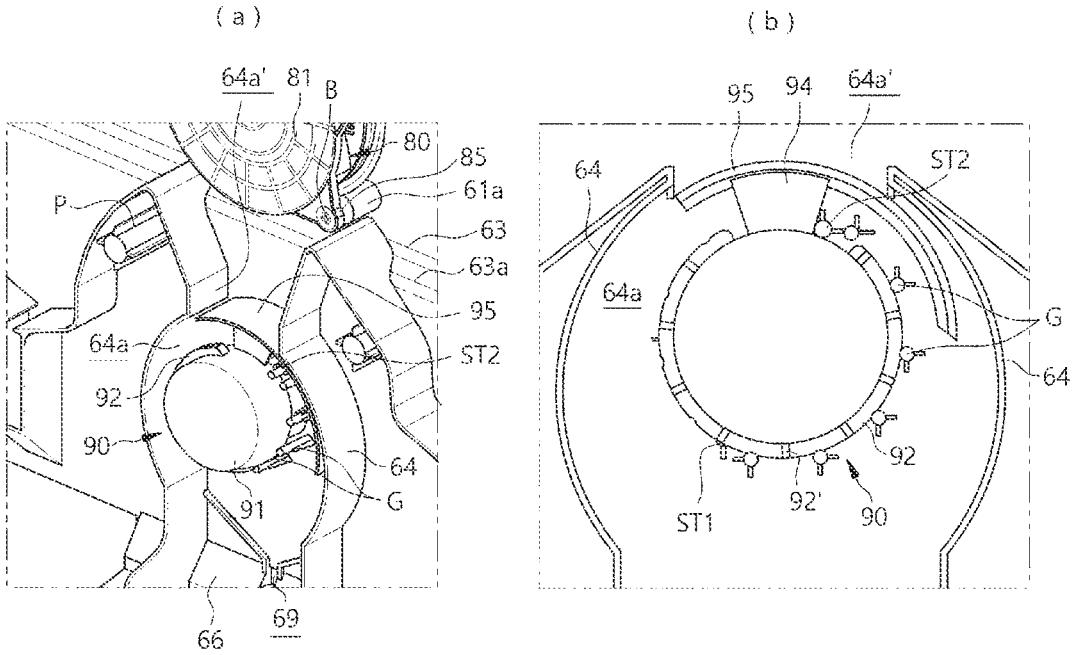
FIGS. 14A and 14B are a perspective view and a front view, respectively, illustrating the minimum opened state of the control knob constituting the refrigerator according to the embodiment of the present disclosure.

Referring to FIG. 13, the surface of the opening/closing blade 95 may have a curved shape, and may be spaced apart from the inner surface of the opening/closing entrance 64*a*' of the flow path for the refrigerating compartment. Accordingly, water flowing down through the refrigeration flow path 64*a*1 and 64*a*2 may not accumulate on the opening/closing blade 95, but may flow downward along the surface of the opening/closing blade 95. Accordingly, the periphery of the control knob 90 may be prevented from freezing.

The opening/closing blade 95 may have a width larger than the width of the opening/closing entrance 64*a*' of the refrigeration flow path 64*a*1 and 64*a*2. Accordingly, as illustrated in FIG. 14B, the opening/closing blade 95 may close the opening/closing entrance 64*a*'.

At the same time, an angle between the opposite ends of the opening/closing blade 95 relative to the center of the control knob 90 may be larger than an angle between the opposite ends of the opening/closing entrance 64*a*' relative to the center of the control knob 90. In this case, the opening/closing blade 95 may cover the entire portion of the opening/closing entrance 64*a'*.

In this case, the opening/closing blade 95 may include an enlarged open part 96*a* and 96*b*. The enlarged open part 96*a* and 96*b* may be formed by recessing a portion of the opening/closing blade 95, and may function to increase the open area of the opening/closing entrance 64*a*' of the refrigeration flow path 64*a*1 and 64*a*2. The enlarged open part 96*a* and 96*b* may be considered as a part at which the width of the opening/closing blade 95 is decreased in the same direction as the direction of the rotating shaft of the control knob 90, which is the front-to-rear directional length of the control knob 90. Due to the enlarged open part 96*a* and 96*b*, the opening/closing entrance 64*a*' may have a predetermined area which is constantly open, and the enlarged open part 96*a* and 96*b* allows the open area of the opening/closing entrance 64*a*' to be more precisely adjusted by the control knob 90.

The enlarged open part 96*a* and 96*b* may include a plurality of enlarged open parts disposed along the rotational direction of the opening/closing blade 95. In the embodiment, the enlarged open part 96*a* and 96*b* may be composed of a first open part 96*a* and a second open part 96*b*, wherein the second open part 96*b* may be larger than the first open part 96*a*. Of course, contrarily, the first open part 96*a* may be larger than the second open part 96*b*, and any one of the first open part 96*a* and the second open part 96*b* may be omitted.

The support legs 97 may protrude on the knob body 91. Each of the support legs 97 may be a part in close contact with the inner surface of the first housing 60 of the grille fan assembly 50. The support legs 97 may have a cantilever structure protruding from the knob body 91 in a direction toward the inner surface of the first housing 60.

In the embodiment, the support leg 97 may include a plurality of support legs disposed along the edge of the lower surface of the knob body 91, and an empty space may be defined between the support legs. Accordingly, cold air may escape through the space between the support legs 97 without being trapped by the support legs 97, and frost may be prevented from occurring at the end portions of the support legs 97.

Referring to FIG. 16, the end portion of the support leg 97 facing the inner surface of the first housing 60 may be configured as a close-contact end part 97' having thickness decreasing gradually toward the inner surface of the first housing 60. The close-contact end part 97' may allow the support leg 97 to be in line contact with the inner surface of the first housing 60 rather than in surface contact therewith. Accordingly, when rotating the control knob 90, friction between the control knob 90 and the first housing 60 may be decreased.

A rotating boss 98 may protrude on the knob body 91. The rotating boss 98 may be a part fitted rotatably to a fixed boss 65 of the grille fan assembly 50. Referring FIG. 16, the fixed boss 65 protrudes on the first housing 60, and is fitted into the rotating boss 98. Accordingly, the control knob 90 may rotate relative to the rotating boss 98 and the fixed boss 65. Accordingly, in the embodiment, the control knob 90 may embody a rotating structure without a separate fastener.

Figure 17:
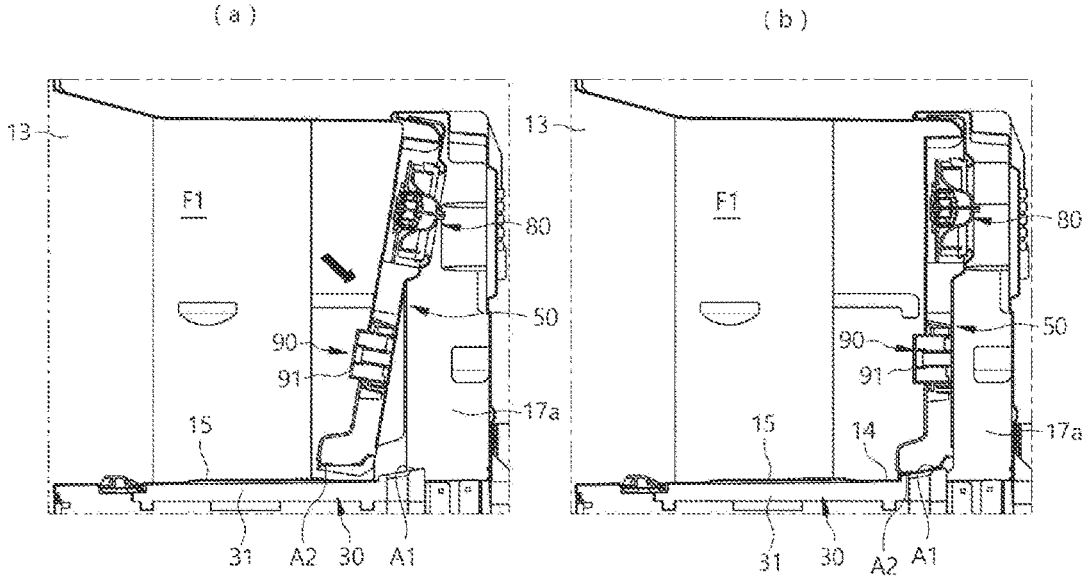
FIGS. 17A and 17B are assembly views sequentially illustrating a process in which the grille fan assembly constituting the refrigerator is mounted to the inside of the freezer compartment according to the embodiment of the present disclosure.

Next, the mounting process of the grille fan assembly 50 of the present disclosure will be described with reference to FIG. 17. First, a worker may push the grille fan assembly 50 inward from the entrance of the upper casing 13. The height of the grille fan assembly 50 may be higher than the height of the freezer compartment F1. Accordingly, a worker may push the grille fan assembly 50 from the entrance of the upper casing 13 by tilting the grille fan assembly 50.

In addition, after the grille fan assembly 50 is moved toward the inside of the upper casing 13, that is, the rear thereof, the upper end of the grille fan assembly 50 may be fitted into the holding groove 19. The holding groove 19 may be a part recessed on the upper end of the rear of the upper casing 13, and the upper end of the grille fan assembly 50 may be fitted into the recessed part. This state is illustrated in FIG. 17A.

In this state, when the lower end of the grille fan assembly 50 is rotated in the direction of the arrow, the second inclined part A2 formed on the lower end of the grille fan assembly 50 may move along the first inclined part A1. When the grille fan assembly 50 is mounted to the inner casing 10, the second inclined part A2 of the grille fan assembly 50 may climb on the sealing foam formed on the upper surface of the first inclined part A1, and the first inclined part A1 and the second inclined part A2 may be in close contact with each other, so the sealing foam located between the first inclined part A1 and the second inclined part A1 may be compressed.

In the embodiment, height between the upper surface of the grille fan assembly 50 and the second inclined part A1 may be larger than height between the holding groove 19 and the first inclined part A1. Accordingly, the sealing foam may be compressed between the first inclined part A1 and the second inclined part A2, and may perform a sealing function.

Accordingly, the grille fan assembly 50 may be assembled rearward from the front of the upper casing 13. While the grille fan assembly 50 is rotated and assembled, the first inclined part A1 and the second inclined part A2 may prevent the interference of the grille fan assembly 50 with the inner surface of the upper casing 13. Particularly, since the interference of the grille fan assembly 50 with the inner surface of the upper casing 13 is prevented in the mounting process of the grille fan assembly 50, the sealing foam may not be damaged or removed, and thus the leakage of cold air may be prevented. A state in which the assembly of the grille fan assembly 50 is completed is illustrated in FIG. 17B.

Figure 18:
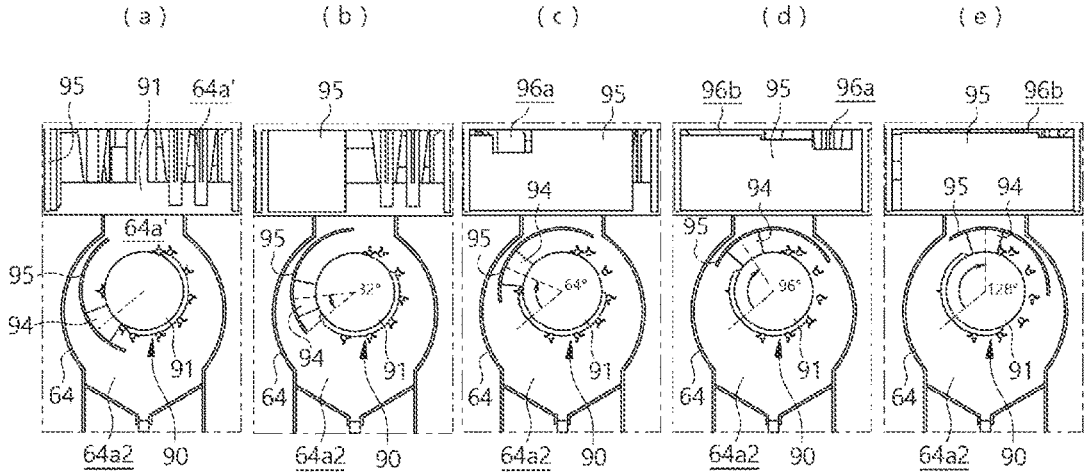
FIGS. 18A to 18E are views illustrating states, respectively, in which the open degree of the entrance of the flow path for the refrigerating compartment is changed according to the rotation angle of the control knob constituting the refrigerator according to the embodiment of the present disclosure.

Next, the process of controlling the amount of blown air (the amount of cold air) to be transmitted to the storage compartment will be described with reference to FIG. 18. For reference, in FIGS. 18A, 18B, 18C, 18D, and 18E, upper drawings illustrate the states of the opening/closing entrance 64*a*' seen from an upper side, and lower drawings illustrate the states of the control knob 90 seen from a front side.

FIG. 18A illustrates a state in which the opening/closing entrance 64*a*' is completely opened by the control knob 90. Accordingly, at the maximum opening angle, the knob body 91 may not rotate any longer counterclockwise. This is because the first stopper ST1 interferes with the connection arm 94 (see FIG. 13B). In this state, the amount of cold air discharged to the refrigerating compartment F2 through the discharge hole 67 from the refrigeration flow path 64*a*1 and 64*a*2 may be maximized.

When a user rotates the control knob 90 clockwise, the control knob 90 may be in a state illustrated in FIG. 18B. This is a state in which the control knob 90 is rotated about 30° and the adjustment jaw G is fitted into the control recess 93 of the angle adjustment part 92, and thus the control knob 90 may be held at a specific angle. Additionally, a user may sense that the adjustment jaw G has been rotated at a specific angle through the feeling of fitting the adjustment jaw G into the control recess 93.

Referring to FIG. 18B, it can be seen that the opening/closing blade 95 does not completely block the opening/closing entrance 64*a*', but around a half thereof.

Next, when a user further rotates the control knob 90 clockwise, the control knob 90 is in a state illustrated in FIG. 18C. This is a state in which the control knob 90 is rotated about 60° and the adjustment jaw G is fitted into the control recess 93 of the angle adjustment part 92, and thus the control knob 90 may be held at a specific angle.

Referring to FIG. 18C, the opposite ends of the opening/closing blade 95 blocks most of the opening/closing entrance 64*a*1, but in the enlarged open parts 96*a* and 96*b*, the first open part 96*a* may overlap the opening/closing entrance 64*a*'. Accordingly, cold air may flow downward through the first open part 96*a*.

In addition, when a user further rotates the control knob 90 clockwise, the control knob 90 is in a state illustrated in FIG. 18D. This is a state in which the control knob 90 is rotated about 90° and the adjustment jaw G is fitted into the control recess 93 of the angle adjustment part 92, and thus the control knob 90 may be held at a specific angle.

Referring to FIG. 18D, the opposite ends of the opening/closing blade 95 completely crosses and blocks the opening/closing entrance 64*a*', but in the enlarged open part 96*a* and 96*b*, the first open part 96*a* and the second open part 96*b* may overlap the opening/closing entrance 64*a*'. Accordingly, cold air may flow downward through the first open part 96*a* and the second open part 96*b*.

Finally, when a user further rotates the control knob 90 clockwise, the control knob 90 is in the state of the minimum opening angle as illustrated in FIG. 18E. This is a state in which the control knob 90 is rotated about 120° and the adjustment jaw G is fitted into the control recess 93 of the angle adjustment part 92, and thus the control knob 90 may be held at a specific angle.

Referring to FIG. 18E, the left end of the opening/closing blade 95 partially opens an end of the opening/closing entrance 64*a*', and in the enlarged open part 96*a* and 96*b*, the second open part 96*b* may overlap the opening/closing entrance 64*a*'. Accordingly, cold air may flow downward through the second open part 96*b*.

At the same time, the connection arm 94 may interfere with the second stopper ST2, and the control knob 90 may not rotate clockwise any longer (see FIG. 14B).

Accordingly, when a user rotates the control knob 90, the open degree of the opening/closing entrance 64*a*' may be gradually decreased from the maximum opening angle of FIG. 18A to the minimum opening angle of FIG. 18E. Additionally, the adjustment jaw G may be fitted into the control recess 93, so at each level, the control knob 90 may be held and may be prevented from randomly rotating clockwise or counterclockwise.

Meanwhile, cold air supplied to the refrigerating compartment F2 along the refrigeration flow path 64*a*1 and 64*a*2 may include water, and the freezing of the water may occur between the opening/closing blade 95 and the opening/closing entrance 64*a*'. However, the surface of the opening/closing blade 95 may be spaced apart by a predetermined distance from the inner surface of the flow guide 64 for the refrigerating compartment, so water may be discharged through a gap defined due to the distance and thus freezing of the water may be prevented. Furthermore, the discharged water may be discharged to the outside of the grille fan assembly 50 through the condensate drain hole 69*a* and then may be collected in the drain tray 37 located under the evaporator to be discharged.

In addition, when the internal temperature of the refrigeration compartment F2 falls within a preset range while cold air is supplied to the refrigerating compartment F2 through the flow guide 64 for the refrigerating compartment, the operations of the blower fan 80 and a compressor may stop.

In the above, even if all components constituting the refrigerator according to the embodiment of the present disclosure have been described as being combined integrally with each other or being operated in combination integrally with each other, the present disclosure is not necessarily limited to this embodiment. That is, as long as it is within the scope of the present disclosure, at least two of all of its components may be selectively combined with each other to be operated.

The invention claimed is:

1. A refrigerator comprising:

a cabinet defining a storage compartment;

a barrier dividing the storage compartment into multiple spaces and having a communication hole defined at an upper surface of the barrier, the communication hole being disposed between the multiple spaces and configured to allow cold air to be transmitted to the multiple spaces;

a grille fan assembly provided at a rear of the storage compartment and having (i) a discharge hole defined at a lower surface of the grille fan assembly such that the discharge hole is coupled to the communication hole, and (ii) a blower fan provided at the grille fan assembly and configured to blow cold air into the storage compartment; and a control knob provided at the grille fan assembly and configured to rotate relative to a rotating shaft, the rotating shaft configured to rotate in the same direction as a direction of a rotating shaft of the blower fan, and the control knob configured to control an amount of cold air blown into the discharge hole based on a rotation angle of the control knob, wherein a plurality of inclined parts are defined at the upper surface of the barrier and at the lower surface of the grille fan assembly, respectively.

2. The refrigerator of claim 1, wherein the plurality of inclined parts comprise:

a first inclined part disposed at the upper surface of the barrier and defined to surround an edge of the communication hole, and a second inclined part disposed at the lower surface of the grille fan assembly and defined to surround an edge of the discharge hole.

3. The refrigerator of claim 2, wherein a height of each of the first inclined part and the second inclined part increases, as the first inclined part and the second inclined part extend toward a rear of the cabinet, and the first inclined part and the second inclined part have the same inclination angle.

4. The refrigerator of claim 2, wherein a sealing foam is disposed at at least one of the first inclined part and the second inclined part, wherein the sealing foam provides sealing at a part at which the communication hole and the discharge hole are coupled to each other, and wherein the first inclined part and the second inclined part are disposed such that the sealing foam between the first inclined part and the second inclined part is compressed.

5. The refrigerator of claim 2, wherein a holding groove is disposed at an upper surface of the storage compartment facing the communication hole, wherein an upper end of the grille fan assembly is inserted into the holding groove, and wherein the first inclined part and the second inclined part are disposed such that a distance between an upper surface of the grille fan assembly and the second inclined part is greater than or equal to a distance between the holding groove and the first inclined part.

6. The refrigerator of claim 2, wherein a mounting part in which the communication hole is defined protrudes from the upper surface of the barrier, and the first inclined part is disposed at an upper surface of the mounting part.

7. The refrigerator of claim 6, wherein the barrier comprises:

a barrier body having a recovery duct disposed therein; and a barrier cover coupled to an upper part of the barrier body and shielding at least a portion of the recovery duct, wherein the mounting part protrudes from an upper surface of the barrier cover.

8. The refrigerator of claim 7, wherein the grille fan assembly comprises a lower plate disposed under the control knob, the discharge hole is defined through the lower plate, and the second inclined part is disposed at a surface of the lower plate facing the upper surface of the barrier cover.

9. The refrigerator of claim 8, wherein the lower plate is disposed to be spaced apart from each of opposite side parts of the grille fan assembly and is provided at a center portion of a lower part of the grille fan assembly.

10. The refrigerator of claim 2, wherein a pair of guide ribs protrudes from the lower surface of the grille fan assembly adjacent to the second inclined part and surrounds a periphery of the first inclined part.

11. The refrigerator of claim 1, wherein the control knob comprises:

a knob body having a cylindrical shape, wherein at least a portion of the knob body protrudes from the grille fan assembly toward a front of the storage compartment;

an angle adjustment part protruding from an outer circumferential surface of the knob body and configured to interfere with an adjustment jaw of the grille fan assembly; and an opening/closing blade coupled with the knob body by a connection arm and having a diameter larger than that of the knob body, wherein the control knob is disposed in a flow path for a refrigerating compartment provided inside the grille fan assembly, and the opening/closing blade is configured to open and close an opening/closing entrance of the flow path for the refrigerating compartment.

12. The refrigerator of claim 11, wherein a surface of the opening/closing blade has a curved shape and is disposed to be spaced apart from an inner surface of the opening/closing entrance of the flow path for the refrigerating compartment, and an angle between opposite ends of the opening/closing blade relative to a center of the control knob is larger than an angle between opposite ends of the opening/closing entrance of the flow path for the refrigerating compartment relative to the center of the control knob.

13. The refrigerator of claim 11, wherein the opening/closing blade has an open part which is recessed in a portion of the opening/closing blade.

14. The refrigerator of claim 13, wherein the open part comprises a plurality of open parts disposed along a rotational direction of the opening/closing blade, the plurality of open parts having different sizes from each other.

15. The refrigerator of claim 11, wherein a rotating boss protrudes from the knob body and is inserted rotatably into a fixed boss of the grille fan assembly, and a support leg protrudes from the knob body and is disposed to be in contact with an inner surface of the grille fan assembly.

16. The refrigerator of claim 15, wherein the support leg comprises a plurality of support legs disposed along an edge of a lower surface of the knob body, wherein an end portion of the support leg facing the inner surface of the grille fan assembly has a thickness that gradually decreases toward the inner surface of the grille fan assembly, and a protrusion part protrudes from the angle adjustment part and is disposed to be in contact with an opposing inner surface facing the inner surface of the grille fan assembly.

17. The refrigerator of claim 11, wherein the angle adjustment part is provided continuously along an outer circumferential surface of the knob body, and a control recess is recessed on a surface of the angle adjustment part such that the adjustment jaw is inserted into the control recess.

18. The refrigerator of claim 11, wherein a stopper protrudes from an inner surface of the grille fan assembly and is configured to interfere with a side surface of the connection arm to limit a maximum rotation angle of the control knob, the stopper comprising a first stopper and a second stopper disposed to be spaced apart from each other such that the first stopper and the second stopper are configured to limit maximum and minimum opening angles of the control knob, respectively.

19. The refrigerator of claim 18, wherein the stopper is defined to have a length that is shorter than a distance by which the angle adjustment part is spaced apart from the inner surface of the grille fan assembly, and wherein the length is longer than a distance by which the connection arm is spaced apart from the inner surface of the grille fan assembly.

20. A refrigerator comprising:

a cabinet defining a storage compartment;

a barrier dividing the storage compartment into multiple spaces and having a communication hole defined at an upper surface of the barrier, the communication hole being disposed between the multiple spaces and configured to allow cold air to be transmitted into the multiple spaces; and a grille fan assembly provided at a rear of the storage compartment and having (i) a discharge hole defined at a lower surface of the grille fan assembly such that the discharge hole is coupled to the communication hole, and (ii) a blower fan provided at the grille fan assembly and configured to blow cold air into the storage compartment, wherein a first inclined part is disposed at the upper surface of the barrier and defined to surround an edge of the communication hole, and a second inclined part is disposed at the lower surface of the grille fan assembly and defined to surround an edge of the discharge hole, wherein the first inclined part and the second inclined part are disposed to be in close contact with each other.

* * * * *